US009500967B2

(12) United States Patent
Murakami et al.

(10) Patent No.: US 9,500,967 B2
(45) Date of Patent: Nov. 22, 2016

(54) ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

(71) Applicant: CANON KABUSHIKI KAISHA, Tokyo (JP)

(72) Inventors: Takeshi Murakami, Numazu (JP); Hiroyuki Tomono, Numazu (JP); Kunihiko Sekido, Suntou-gun (JP); Atsushi Okuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 52 days.

(21) Appl. No.: 14/509,245

(22) Filed: Oct. 8, 2014

(65) Prior Publication Data

US 2015/0099218 A1 Apr. 9, 2015

(30) Foreign Application Priority Data

Oct. 9, 2013 (JP) ..... 2013-211991
Aug. 29, 2014 (JP) ..... 2014-176312

(51) Int. Cl.

| | |
|---|---|
| ***G03G 15/04*** | (2006.01) |
| ***G03G 5/14*** | (2006.01) |
| ***G03G 15/00*** | (2006.01) |
| ***G03G 5/06*** | (2006.01) |
| ***G03G 5/07*** | (2006.01) |
| ***G03G 5/147*** | (2006.01) |

(52) U.S. Cl.

CPC ..... *G03G 5/144* (2013.01); *G03G 5/0614* (2013.01); *G03G 5/071* (2013.01); *G03G 5/142* (2013.01); *G03G 5/14791* (2013.01); *G03G 15/75* (2013.01)

(58) Field of Classification Search

CPC ..... G03G 5/144; G03G 5/14791; G03G 5/0614; G03G 5/071; G03G 5/142
USPC ..... 430/65, 130; 399/111, 159
See application file for complete search history.

(56) References Cited

U.S. PATENT DOCUMENTS

| | | | |
|---|---|---|---|
| 4,442,193 | A | 4/1984 | Chen |
| 4,562,132 | A | 12/1985 | Ong |
| 4,992,349 | A | 2/1991 | Chen |
| 5,468,583 | A | 11/1995 | Gruenbaum |

(Continued)

FOREIGN PATENT DOCUMENTS

| | | | |
|---|---|---|---|
| JP | 1-206349 | A | 8/1989 |
| JP | 1993-27470 | A | 2/1993 |
| JP | 1993-279582 | A | 10/1993 |

(Continued)

OTHER PUBLICATIONS

Tetrahedron Letters, 2002, 43(16), pp. 2991-2994.
Tetrahedron Letters, 2003, 44(10), 2087-2091.
Journal of the Imaging Society of Japan, 2006, vol. 45, No. 6, pp. 521-525.

(Continued)

*Primary Examiner* — Thorl Chea
(74) *Attorney, Agent, or Firm* — Canon U.S.A., Inc., IP Division

(57) ABSTRACT

An undercoat layer of an electrophotographic photosensitive member includes a product having electron transportability and a particle including titanium oxide, and a surface layer of the electrophotographic photosensitive member includes a product of a composition including a hole transporting substance having a polymerizable functional group and a photopolymerization initiator.

19 Claims, 2 Drawing Sheets

(56) References Cited

U.S. PATENT DOCUMENTS

| | | | | |
|---|---|---|---|---|
| 5,795,690 | A * | 8/1998 | Takegawa | G03G 5/0657 430/58.25 |
| 2005/0019684 | A1 * | 1/2005 | Sekiya | G03G 5/04 430/66 |

FOREIGN PATENT DOCUMENTS

| | | | |
|---|---|---|---|
| JP | 1995-070038 | A | 3/1995 |
| JP | 2000-066425 | A | 3/2000 |
| JP | 2004-302450 | A | 10/2004 |
| JP | 2007-148357 | A | 6/2007 |

OTHER PUBLICATIONS

Journal of Synthetic Organic Chemistry, Japan, 1957, vol. 15, pp. 29-32.
Journal of Synthetic Organic Chemistry, Japan, 1957, vol. 15, pp. 32-34.
Chemical Society of Japan, 1992, vol. 65, pp. 1006-1011.
PPCI/Japan Hard Copy '98 Proceedings, p. 207 (1998).
Chemistry of Materials, 2007, vol. 19, No. 11, pp. 2703-2705.
Journal of the American Chemical Society, 2007, vol. 129, No. 49, pp. 15259-15278.
Chemical Educator, 2001, No. 6, pp. 227-234.

* cited by examiner

ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a method for producing the electrophotographic photosensitive member, a process cartridge, and an electrophotographic apparatus.

2. Description of the Related Art

An example of electrophotographic photosensitive members installed in process cartridges and electrophotographic apparatuses is an electrophotographic photosensitive member including an organic photoconductive substance (i.e., charge generating substance). Generally, an electrophotographic photosensitive member includes a support and a photosensitive layer, which is constituted by a charge generation layer and a charge transportation layer, formed on the support. An undercoat layer is interposed between the support and the photosensitive layer in order to suppress injection of charge from the support into the photosensitive layer and thereby suppress occurrence of image defects such as fogging.

Recently, a charge generating substance having high sensitivity has been employed. However, the higher the sensitivity of the charge generating substance, the stronger the tendency of charge to remain at the interface between the photosensitive layer and the undercoat layer due to an increase in the amount of charge generated. In the case where images are formed repeatedly for a long period of time in this state, a large change in the surface potential of the electrophotographic photosensitive member may occur, which is likely to cause image defects such as ghost images. In Japanese Patent Laid-Open No. 2007-148357, a technique in which titanium oxide particles are added to the undercoat layer in order to suppress the potential change is described.

Recently, there have been demands for an increase in the print speed of electrophotographic apparatuses and a decrease in the amount of maintenance required, and therefore there has also been a demand for enhancement of the durability of an electrophotographic photosensitive member. Accordingly, there has been proposed a technique in which a curable resin is added to the surface layer of an electrophotographic photosensitive member in order to enhance the mechanical durability (i.e., wear resistance) of the electrophotographic photosensitive member. In Japanese Patent Laid-Open No. 2000-66425, a surface layer including a cured product of a charge transporting compound having two or more polymerizable functional groups per molecule is described. In Japanese Patent Laid-Open No. 2004-302450, a surface layer including a cured product formed by irradiating a composition including a charge transporting compound having one polymerizable functional group, a radical-polymerizable monomer which has three or more polymerizable functional groups and which does not have hole transportability, and a photopolymerization initiator with ultraviolet radiation is described.

However, as a result of studies conducted by the inventors of the present invention, the following problem was found in an electrophotographic photosensitive member constituted by an undercoat layer including titanium oxide and a surface layer including a cured product formed by irradiating, with ultraviolet radiation, a composition including a compound having a polymerizable functional group and a photopolymerization initiator. Specifically, there were cases where black-dot-like image defects (hereinafter, referred to as "black dots") were likely to occur.

SUMMARY OF THE INVENTION

The present invention is directed to providing an electrophotographic photosensitive member including an undercoat layer formed on a support and a surface layer formed on the undercoat layer, with which occurrence of black dots may be suppressed and to providing a method for producing the electrophotographic photosensitive member. The present invention is directed also to a process cartridge and an electrophotographic apparatus that include the above-described electrophotographic photosensitive member.

According to one aspect of the present invention, there is provided an electrophotographic photosensitive member including: a support; an undercoat layer formed on the support; and a photosensitive layer formed on the undercoat layer.

The undercoat layer includes: a cured product having electron transportability; and a particle including titanium oxide.

A surface layer of the electrophotographic photosensitive member includes a cured product of a composition including: a hole transporting substance having a polymerizable functional group; and a photopolymerization initiator.

According to another aspect of the present invention, there is provided a method for producing an electrophotographic photosensitive member including a support, an undercoat layer formed on the support, and a photosensitive layer formed on the undercoat layer, the method including the steps of:

(i) forming the undercoat layer including a cured product having electron transportability and a particle including titanium oxide;

(ii) forming a coating film of a coating liquid, the coating liquid including a composition including a hole transporting substance having a polymerizable functional group and a photopolymerization initiator; and (iii) irradiating the coating film with ultraviolet radiation to cause the composition to be cured in order to form a surface layer of the electrophotographic photosensitive member.

According to still another aspect of the present invention, there is provided a method for producing an electrophotographic photosensitive member including a support, an undercoat layer formed on the support, and a photosensitive layer formed on the undercoat layer, the undercoat layer being a laminated undercoat layer including a first undercoat layer and a second undercoat layer formed on the first undercoat layer, the method including the steps of:

(i) forming the first undercoat layer including a particle including titanium oxide;

(ii) forming the second undercoat layer on the first undercoat layer, the second undercoat layer including a cured product having electron transportability;

(iii) forming a coating film of a coating liquid, the coating liquid including a composition including a hole transporting substance having a polymerizable functional group and a photopolymerization initiator; and (iv) irradiating the coating film with ultraviolet radiation to cause the composition to be cured in order to form a surface layer of the electrophotographic photosensitive member.

According to yet another aspect of the present invention, there is provided a process cartridge detachably attachable to a main body of an electrophotographic apparatus, the process cartridge integrally supporting: the above-described electrophotographic photosensitive member; and at least one unit selected from the group consisting of a charging unit, a developing unit, and a cleaning unit.

According to a further aspect of the present invention, there is provided an electrophotographic apparatus including: the above-described electrophotographic photosensitive member; a charging unit; a developing unit; and a transfer unit.

According to the present invention, an electrophotographic photosensitive member including an undercoat layer formed on a support and a surface layer formed on the undercoat layer, with which occurrence of black dots may be suppressed and a method for producing the electrophotographic photosensitive member may be provided. According to the present invention, a process cartridge and an electrophotographic apparatus that include the above-described electrophotographic photosensitive member may also be provided.

Further features of the present invention will become apparent from the following description of exemplary embodiments with reference to the attached drawings.

DESCRIPTION OF THE EMBODIMENTS

Figure 1:
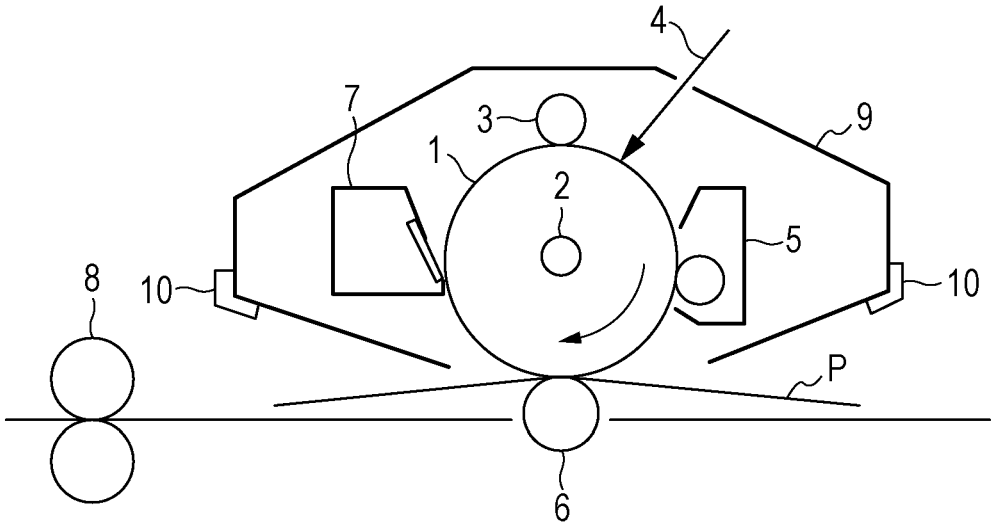
FIG. 1 is a schematic diagram illustrating an example of the structure of an electrophotographic apparatus including a process cartridge including an electrophotographic photosensitive member according to an embodiment of the present invention.

The electrophotographic photosensitive member according to the embodiment includes an undercoat layer including a cured product having electron transportability and particles including titanium oxide; and a surface layer including a cured product of a composition including a hole transporting substance having a polymerizable functional group and a photopolymerization initiator. In the case where the undercoat layer is a laminated undercoat layer constituted by a first undercoat layer and a second undercoat layer formed on the first undercoat layer, the first undercoat layer includes the particles including titanium oxide and the second undercoat layer includes the cured product having electron transportability.

The inventors of the present invention think that the above-described electrophotographic photosensitive member according to the embodiment is effective at suppressing the occurrence of black dots for the following reasons.

When a coating film that is formed by applying a surface-layer coating liquid including the above-described composition onto the undercoat layer including particles including titanium oxide is irradiated with ultraviolet radiation (i.e., cured), titanium oxide is irradiated with ultraviolet radiation and absorbs an energy derived from ultraviolet radiation. Consequently, $O^{2-}$ atoms in titanium oxide gain the outer-shell electrons of the adjacent $Ti^{4+}$ atoms to form $O_2$ molecules, which are released outside the titanium oxide crystal. This leads to formation of lattice vacancy in titanium oxide, and holes and free electrons remain in the lattice vacancy formed due to the release of oxygen atoms. The holes and free electrons are capable of migrating inside the titanium oxide crystal, which is likely to increase the conductivity of the crystal. This increases the risk of local leakage of charge, which leads to the problem of black dots due to the leakage.

In order to address the problem, in the electrophotographic photosensitive member according to the embodiment, the undercoat layer further includes a cured product having electron transportability. It is considered that this allows the holes and free electrons, which are generated from titanium oxide when the coating film of the surface-layer coating liquid including the composition is irradiated with ultraviolet radiation, to recombine with each other in the cured product having electron transportability, which suppresses an increase in the conductivity of the titanium oxide crystal. It is considered that this suppresses the occurrence of black dots.

The structure of the electrophotographic photosensitive member according to the embodiment is described below. The electrophotographic photosensitive member according to the embodiment includes a support, an undercoat layer formed on the support, and a photosensitive layer formed on the undercoat layer. The undercoat layer may be a laminated undercoat layer constituted by a first undercoat layer and a second undercoat layer formed on the first undercoat layer. The photosensitive layer, which is formed on the undercoat layer, may be a laminated (separated function) photosensitive layer that is divided into a charge generation layer including a charge generating substance and a charge transportation layer including a charge transporting substance. A surface layer (protection layer) may optionally be formed on the charge transportation layer. Alternatively, the charge transportation layer may serve as a surface layer.

Figure 2A:
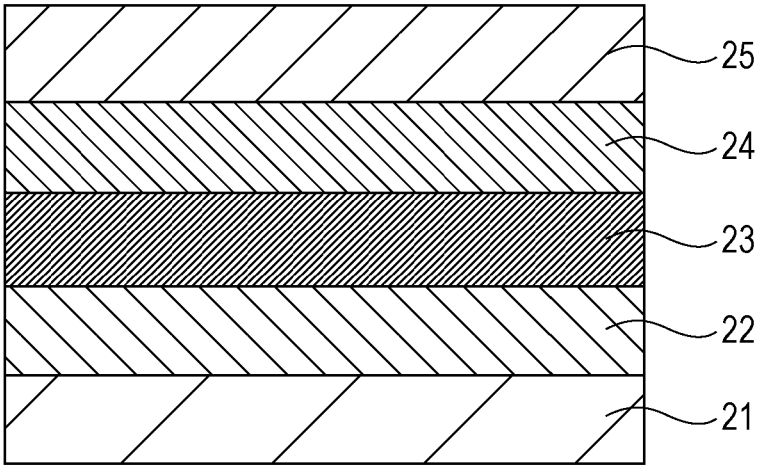
FIGS. 2A and 2B are diagrams illustrating examples of the structure of an electrophotographic photosensitive member according to an embodiment of the present invention.
Figure 2B:
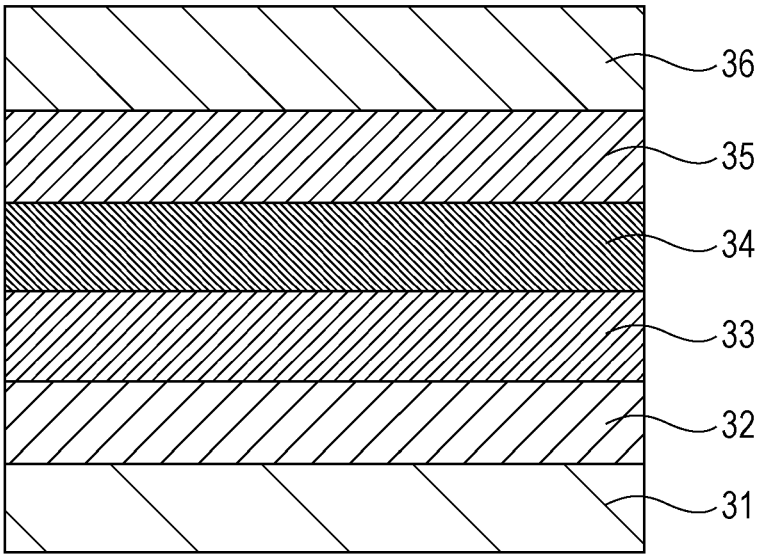

FIGS. 2A and 2B are diagrams illustrating examples of the structure of the electrophotographic photosensitive member. FIG. 2A shows an electrophotographic photosensitive member including a support 21, an undercoat layer 22, a charge generation layer 23, a hole transportation layer 24, and a surface layer 25. FIG. 2B shows an electrophotographic photosensitive member including a laminated undercoat layer. The electrophotographic photosensitive member shown in FIG. 2B includes a support 31, a first undercoat layer 32, a second undercoat layer 33, a charge generation layer 34, a hole transportation layer 35, and a surface layer 36.

Undercoat Layer

In the electrophotographic photosensitive member according to the embodiment, the undercoat layer includes a cured product having electron transportability and particles including titanium oxide. In the case where the undercoat layer is a laminated undercoat layer, the first undercoat layer includes the particles including titanium oxide, and the second undercoat layer includes the cured product having electron transportability.

The cured product having electron transportability is a three dimensional crosslinked product including a portion having electron transportability as a partial structure. The cured product having electron transportability may be produced by curing the following compositions:

a composition including an electron transporting substance having two or more polymerizable functional groups;

a composition including an electron transporting substance having two or more polymerizable functional groups and a crosslinking agent; and a composition including an electron transporting substance having one polymerizable functional group and a crosslinking agent.

Among the above-described compositions, from the viewpoint of the uniformity of the coating film, it is preferable to use a cured product of a composition including an electron transporting substance having one or more polymerizable functional groups and a crosslinking agent.

Optionally, a resin having a polymerizable functional group may be further added to the composition including the electron transporting substance and the crosslinking agent in order to cure the composition into the cured product having electron transportability.

Using the three-dimensional crosslinked product (cured product having electron transportability) as an electron transporting substance, the potential change caused due to degradation of the electron transporting substance may be suppressed. Using the electron transporting substance for recombining holes and free electrons generated from titanium oxide irradiated with ultraviolet radiation is likely to cause degradation of the electron transporting substance due to a change in electronic state associated with deactivation of the triplet state, that is, a change in the material structure. Degradation of the electron transporting substance may inhibit injection of electrons from the photosensitive layer into the undercoat layer, which may cause the potential change. However, it is considered that use of the cured product having electron transportability as an electron transporting substance allows deactivation of the triplet state while suppressing a changes in the material structure, which suppresses degradation of the electron transporting substance.

In order to suppress the occurrence of black dots with great effect as well as degradation of the electron transporting substance, the following conditions are preferably satisfied because, when the conditions are satisfied, the holes and free electrons generated from titanium oxide irradiated with ultraviolet radiation are likely to be deactivated.

The band gap (T1) between the ground state and the triplet excited level of the electron transporting substance included in the cured product having electron transportability is preferably 0.5 eV or more and 3.0 eV or less and is more preferably 0.5 eV or more and 2.7 eV or less in order to reduce a change in the electronic state and achieve quick deactivation.

Electron Transporting Substance

The electron transporting substance included in the cured product having electron transportability may be an organic electron transporting substance, and examples thereof include quinones, imides, imidazoles, and cyclopentadienylidenes. Specific examples of the electron transporting substance include the electron transporting substances represented by Structural Formulae (A-1) to (A-10) below.

(A-1)

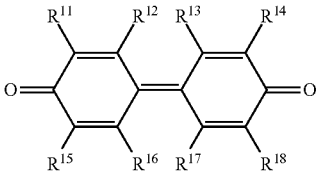

-continued (A-2)

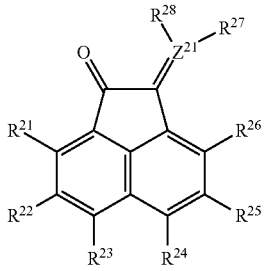

(A-3)

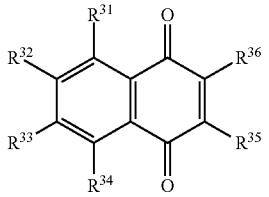

(A-4)

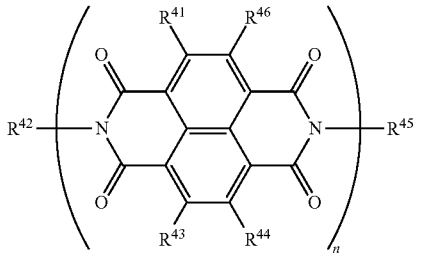

(A-5)

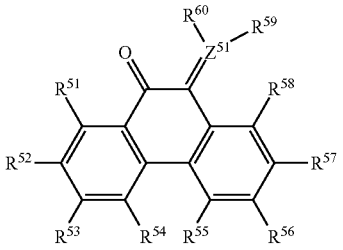

(A-6)

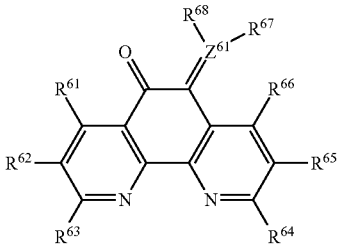

(A-7)

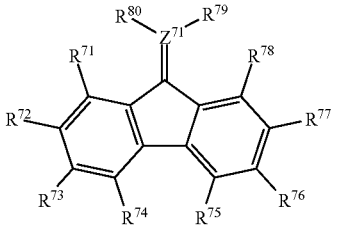

-continued (A-8)

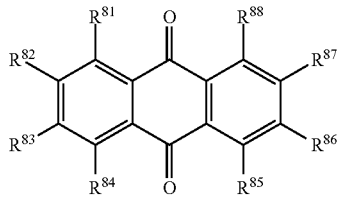

(A-9)

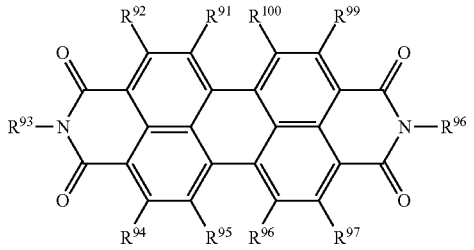

(A-10)

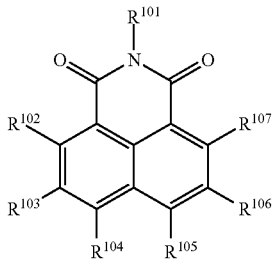

In Structural Formulae (A-1) to (A-10), $R^{11}$ to $R^{18}$, $R^{21}$ to $R^{28}$, $R^{31}$ to $R^{36}$, $R^{41}$ to $R^{46}$, $R^{51}$ to $R^{60}$, $R^{61}$ to $R^{68}$, $R^{71}$ to $R^{80}$, $R^{81}$ to $R^{88}$, $R^{91}$ to $R^{100}$, and $R^{101}$ to $R^{107}$ each independently represent a hydrogen atom, a cyano group, a nitro group, a halogen atom, an alkoxycarbonyl group, a hydroxyalkyl group, a hydroxy group, a thiol group, an amino group, a carboxyl group, a methoxy group, an unsubstituted or substituted alkyl group, an unsubstituted or substituted aryl group, or an unsubstituted or substituted heterocyclic group; one of the carbon atoms in the main chain of the alkyl group may be replaced by an oxygen atom or a nitrogen atom; the substituent of the substituted alkyl group may be an alkyl group, an aryl group, a hydroxyalkyl group, a carboxyl group, a halogen atom, or a carbonyl group; the substituent of the substituted aryl group and the substituent of the heterocyclic group may be a halogen atom, a nitro group, a cyano group, an alkyl group, a halogenated alkyl group, a hydroxyalkyl group, a carboxyl group, a carboxymethyl group, an amino group, a thiol group, an alkoxy group, or a carbonyl group; $Z^{21}$, $Z^{51}$, $Z^{61}$, and $Z^{71}$ each independently represent a carbon atom, a nitrogen atom, or an oxygen atom; if $Z^{21}$ is an oxygen atom, $R^{27}$ and $R^{28}$ are absent; if $Z^{21}$ is a nitrogen atom, $R^{28}$ is absent; if $Z^{51}$ is an oxygen atom, $R^{59}$ and $R^{60}$ are absent; if $Z^{51}$ is a nitrogen atom, $R^{60}$ is absent; if $Z^{61}$ is an oxygen atom, $R^{67}$ and $R^{68}$ are absent; if $Z^{61}$ is a nitrogen atom, $R^{68}$ is absent; if $Z^{71}$ is an oxygen atom, $R^{79}$ and $R^{80}$ are absent; if $Z^{71}$ is a nitrogen atom, $R^{80}$ is absent; and n is 1 or 2.

Among the above-described electron transporting substances, the electron transporting substance represented by Structural Formula (A-4) above is preferably used. More preferably, the electron transporting substance represented by Structural Formula (A-4) in which n=2 is used.

T1 of the electron transporting substance, which is the band gap between the ground state and the triplet excited level, is determined by structure optimization on the basis of the density functional theory (DFT) using a Gaussian base. Energy in the excited state is calculated on the basis of the time-dependent density functional theory (TDDFT). In DFT, the exchange-correlation interaction is approximated using one-electron potential functionals, i.e., functions of another function, which is expressed by electron density. The weighting factor of each parameter associated with exchange-correlation energy is calculated using hybrid B3LYP functionals. The 6-31G basis functions are applied to each atom.

The polymerizable functional group included in the electron transporting substance may be a hydroxy group, a thiol group, an amino group, or a carboxyl group. The crosslinking agent has a functional group that causes polymerization with the polymerizable functional group of the electron transporting substance. The crosslinking agent, after a coating film is deposited, causes polymerization (i.e., curing) with the polymerizable functional group through a chemical reaction. The chemical reaction may be promoted by applying energy such as heat.

Tables 1 to 10 show specific examples of the electron transporting substances (A-1) to (A-10) having a polymerizable functional group. However, the present invention is not limited to these examples. The forms of the electron transporting substances (A-1) to (A-10) are not limited as long as the electron transporting substance has a polymerizable functional group. However, it is preferable that a molecular chain is interposed between the polymerizable functional group and the structure represented by Structural Formulae (A-1) to (A-10).

TABLE 1

| | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| A101 | 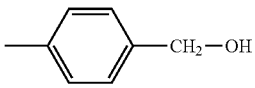 | H | H | H | H | H | H | H |
| A102 | 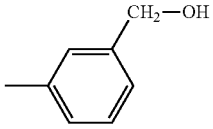 | H | H | H | H | H | H | H |

TABLE 1-continued
| | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| A103 | 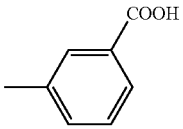 | H | H | H | H | H | H | H |
| A104 | 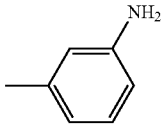 | H | H | H | H | H | H | H |
| A105 | 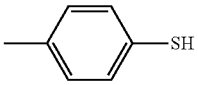 | H | H | H | H | H | H | H |
| A106 | 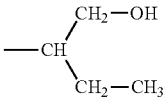 | H | H | H | H | H | H | H |
| A107 | COOH | H | H | H | H | H | H | H |
| A108 | $NH_2$ | H | H | H | H | H | H | H |
| A109 | $-(CH_2)_3-OH$ | H | H | H | $-(CH_2)_3-OH$ | H | H | H |
| A110 | COOH | H | H | H | COOH | H | H | H |
| A111 | 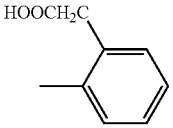 | H | H | H | $-CH_2-COOH$ | H | H | H |
| A112 | 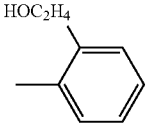 | H | H | H | $-(CH_2)_5-OH$ | H | H | H |
| A113 | $-(CH_2)_3-OH$ | H | H | $-(CH_2)_3-OH$ | $-(CH_2)_3-OH$ | H | H | H |
TABLE 2
| | $R^{21}$ | $R^{22}$ | $R^{23}$ | $R^{24}$ | $R^{25}$ | $R^{26}$ | $R^{27}$ | $R^{28}$ | $Z^{21}$ |
|---|---|---|---|---|---|---|---|---|---|
| A201 | H | H | 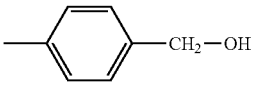 | H | H | H | CN | CN | C |
| A202 | H | H | 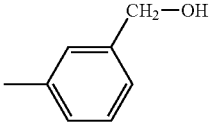 | H | H | H | CN | CN | C |
| A203 | H | H | 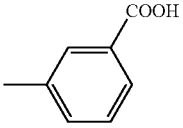 | H | H | H | CN | CN | C |

TABLE 2-continued
| | $R^{21}$ | $R^{22}$ | $R^{23}$ | $R^{24}$ | $R^{25}$ | $R^{26}$ | $R^{27}$ | $R^{28}$ | $Z^{21}$ |
|---|---|---|---|---|---|---|---|---|---|
| A204 | H | H | 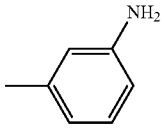 | H | H | H | CN | CN | C |
| A205 | H | H | 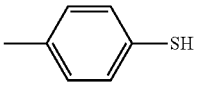 | H | H | H | — | CN | N |
| A206 | H | H | 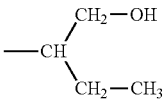 | H | H | H | — | CN | N |
| A207 | H | H | COOH | H | H | H | — | CN | N |
| A208 | H | H | $NH_2$ | H | H | H | — | CN | N |
| A209 | H | H | $-(CH_2)_3-OH$ | H | H | H | — | — | O |
| A210 | H | H | 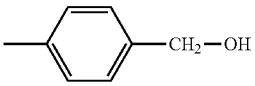 | 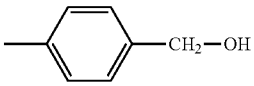 | H | H | — | — | O |
| A211 | H | H | COOH | COOH | H | H | — | — | O |
TABLE 3
| | $R^{31}$ | $R^{32}$ | $R^{33}$ | $R^{34}$ | $R^{35}$ | $R^{36}$ |
|---|---|---|---|---|---|---|
| A301 | H | H | H | H | H | 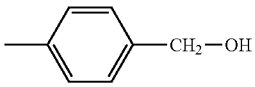 |
| A302 | H | H | H | H | H | 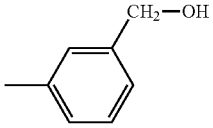 |
| A303 | H | H | H | H | H | 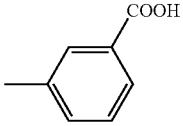 |
| A304 | H | H | H | H | H | 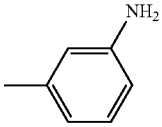 |
| A305 | H | H | H | H | H | 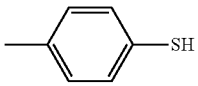 |
| A306 | H | H | H | H | H | 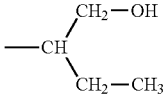 |
| A307 | H | H | H | H | H | COOH |
| A308 | H | H | H | H | H | $NH_2$ |

TABLE 3-continued
| | $R^{31}$ | $R^{32}$ | $R^{33}$ | $R^{34}$ | $R^{35}$ | $R^{36}$ |
|---|---|---|---|---|---|---|
| A309 | H | H | H | H | H | $-(CH_2)_3-OH$ |
| A310 | H | H | H | H | $-(CH_2)_2-OH$ | $-(CH_2)_2-OH$ |
| A311 | H | H | H | H | COOH | COOH |
| A312 | H | H | $-(CH_2)_3-OH$ | H | $-(CH_2)_3-OH$ | $-(CH_2)_3-OH$ |
TABLE 4
| | $n$ | $R^{41}$ | $R^{42}$ | $R^{43}$ | $R^{44}$ | $R^{45}$ | $R^{46}$ |
|---|---|---|---|---|---|---|---|
| A401 | 2 | H | 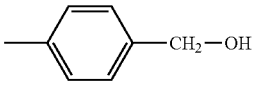 | H | H | H | H |
| A402 | 2 | H | 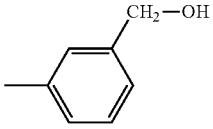 | H | H | H | H |
| A403 | 2 | H | 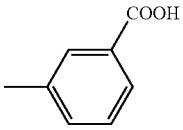 | H | H | H | H |
| A404 | 2 | H | 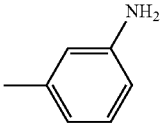 | H | H | H | H |
| A405 | 1 | H | 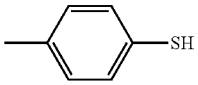 | H | H | H | H |
| A406 | 2 | H | 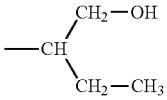 | H | H | H | H |
| A407 | 2 | H | COOH | H | H | H | H |
| A408 | 1 | H | $NH_2$ | H | H | H | H |
| A409 | 2 | H | $-(CH_2)_3-OH$ | H | H | H | H |
| A410 | 2 | H | $-(CH_2)_2-OH$ | H | H | $-(CH_2)_2-OH$ | H |
| A411 | 1 | H | COOH | H | H | COOH | H |
TABLE 5
| | $R^{51}$ | $R^{52}$ | $R^{53}$ | $R^{54}$ | $R^{55}$ | $R^{56}$ | $R^{57}$ | $R^{58}$ | $R^{59}$ | $R^{60}$ | $Z^{51}$ |
|---|---|---|---|---|---|---|---|---|---|---|---|
| A501 | H | 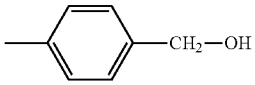 | H | H | H | H | H | H | — | — | O |

TABLE 5-continued
| | $R^{51}$ | $R^{52}$ | $R^{53}$ | $R^{54}$ | $R^{55}$ | $R^{56}$ | $R^{57}$ | $R^{58}$ | $R^{59}$ | $R^{60}$ | $Z^{51}$ |
|---|---|---|---|---|---|---|---|---|---|---|---|
| A502 | H | 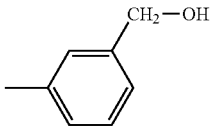 | H | H | H | H | H | H | — | — | O |
| A503 | H | 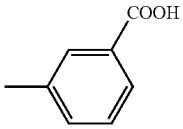 | H | H | H | H | H | H | — | — | O |
| A504 | H | 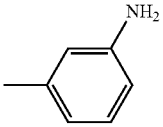 | H | H | H | H | H | H | CN | CN | C |
| A505 | H | 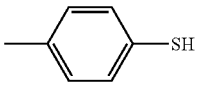 | H | H | H | H | H | H | CN | CN | C |
| A506 | H | 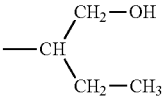 | H | H | H | H | H | H | CN | CN | C |
| A507 | H | COOH | H | H | H | H | H | H | — | CN | N |
| A508 | H | $NH_2$ | H | H | H | H | H | H | — | CN | N |
| A509 | H | $-(CH_2)_3-OH$ | H | H | H | H | H | H | — | — | O |
| A510 | H | COOH | H | H | H | COOH | H | H | — | — | O |
| A511 | H | COOH | H | H | H | H | COOH | H | — | — | O |
| A512 | H | $HOOCH_2C$ 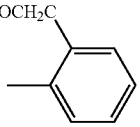 | H | H | H | H | $—CH_2—COOH$ | H | — | — | O |
| A513 | H | $HOC_2H_4$ 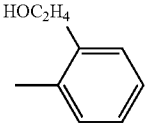 | H | H | H | H | $-(CH_2)_5-OH$ | H | — | — | O |
| A513 | 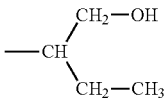 | H | 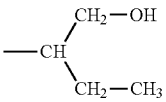 | H | H | H | 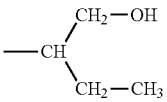 | H | — | — | O |
TABLE 6
| | $R^{61}$ | $R^{62}$ | $R^{63}$ | $R^{64}$ | $R^{65}$ | $R^{66}$ | $R^{67}$ | $R^{68}$ | $Z^{61}$ |
|---|---|---|---|---|---|---|---|---|---|
| A601 | H | 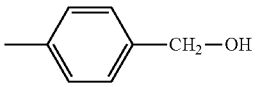 | H | H | H | H | — | — | O |
| A602 | H | 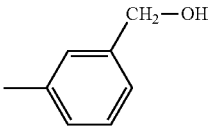 | H | H | H | H | — | — | O |

TABLE 6-continued
| | $R^{61}$ | $R^{62}$ | $R^{63}$ | $R^{64}$ | $R^{65}$ | $R^{66}$ | $R^{67}$ | $R^{68}$ | $Z^{61}$ |
|---|---|---|---|---|---|---|---|---|---|
| A603 | H | 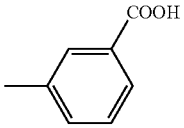 | H | H | H | H | — | — | O |
| A604 | H | 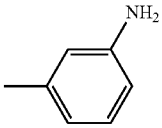 | H | H | H | H | CN | CN | C |
| A605 | H | 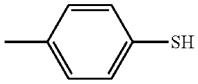 | H | H | H | H | CN | CN | C |
| A606 | H | 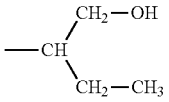 | H | H | H | H | CN | CN | C |
| A607 | H | COOH | H | H | H | H | — | CN | N |
| A608 | H | $NH_2$ | H | H | H | H | — | CN | N |
| A609 | H | $-(CH_2)_3-OH$ | H | H | H | H | — | — | O |
| A610 | H | COOH | H | COOH | H | H | — | — | O |
| A611 | H | COOH | H | H | COOH | H | — | — | O |
| A612 | H | 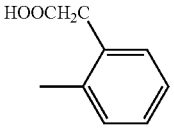 | H | H | $-CH_2-COOH$ | H | — | — | O |
| A613 | H | 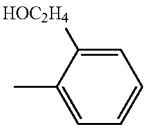 | H | H | $-(CH_2)_5-OH$ | H | — | — | O |
TABLE 7
| | $R^{71}$ | $R^{72}$ | $R^{73}$ | $R^{74}$ | $R^{75}$ | $R^{76}$ | $R^{77}$ | $R^{78}$ | $R^{79}$ | $R^{80}$ | $Z^{71}$ |
|---|---|---|---|---|---|---|---|---|---|---|---|
| A701 | H | 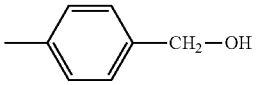 | H | H | H | H | H | H | — | — | O |
| A702 | H | 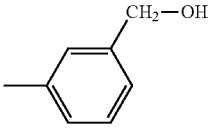 | H | H | H | H | H | H | — | — | O |
| A703 | H | 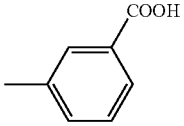 | H | H | H | H | H | H | — | — | O |

TABLE 7-continued
| | $R^{71}$ | $R^{72}$ | $R^{73}$ | $R^{74}$ | $R^{75}$ | $R^{76}$ | $R^{77}$ | $R^{78}$ | $R^{79}$ | $R^{80}$ | $Z^{71}$ |
|---|---|---|---|---|---|---|---|---|---|---|---|
| A704 | H | 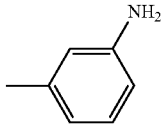 | H | H | H | H | H | H | CN | CN | C |
| A705 | H | 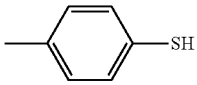 | H | H | H | H | H | H | CN | CN | C |
| A706 | H | 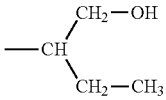 | H | H | H | H | H | H | CN | CN | C |
| A707 | H | COOH | H | H | H | H | H | H | — | CN | N |
| A708 | H | $NH_2$ | H | H | H | H | H | H | — | CN | N |
| A709 | H | $-(CH_2)_3-OH$ | H | H | H | H | H | H | — | — | O |
| A710 | H | COOH | H | H | H | COOH | H | H | — | — | O |
| A711 | H | COOH | H | H | H | H | COOH | H | — | — | O |
| A712 | H | 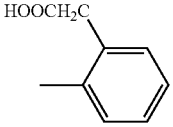 | H | H | H | H | $-CH_2-COOH$ | H | — | — | O |
| A713 | H | 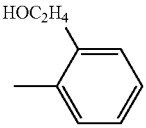 | H | H | H | H | $-(CH_2)_5-OH$ | H | — | — | O |
TABLE 8
| | $R^{81}$ | $R^{82}$ | $R^{83}$ | $R^{84}$ | $R^{85}$ | $R^{86}$ | $R^{87}$ | $R^{88}$ |
|---|---|---|---|---|---|---|---|---|
| A801 | 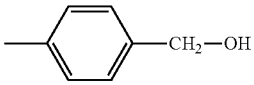 | H | H | H | H | H | H | H |
| A802 | 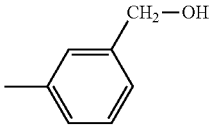 | H | H | H | H | H | H | H |
| A803 | 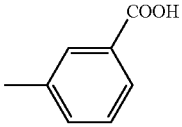 | H | H | H | H | H | H | H |
| A804 | 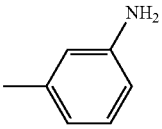 | H | H | H | H | H | H | H |
| A805 | 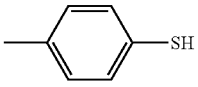 | H | H | H | H | H | H | H |

TABLE 8-continued
| | $R^{81}$ | $R^{82}$ | $R^{83}$ | $R^{84}$ | $R^{85}$ | $R^{86}$ | $R^{87}$ | $R^{88}$ |
|---|---|---|---|---|---|---|---|---|
| A806 | 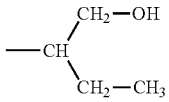 | H | H | H | H | H | H | H |
| A807 | COOH | H | H | H | H | H | H | H |
| A808 | $NH_2$ | H | H | H | H | H | H | H |
| A809 | $-(CH_2)_3-OH$ | H | H | H | H | H | H | H |
| A810 | 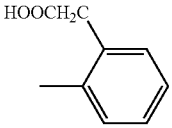 | H | H | 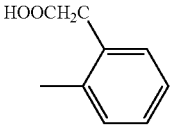 | H | H | H | H |
| A811 | 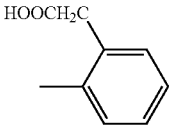 | H | H | H | 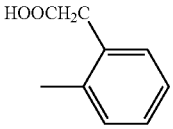 | H | H | H |
| A812 | 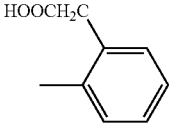 | H | H | H | H | H | 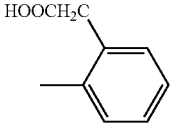 | H |
TABLE 9
| | $R^{91}$ | $R^{92}$ | $R^{93}$ | $R^{94}$ | $R^{95}$ | $R^{96}$ | $R^{97}$ | $R^{98}$ | $R^{99}$ | $R^{100}$ |
|---|---|---|---|---|---|---|---|---|---|---|
| A901 | H | H | 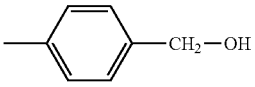 | H | H | H | H | H | H | H |
| A902 | H | H | 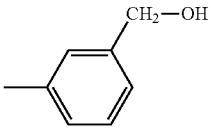 | H | H | H | H | H | H | H |
| A903 | H | H | 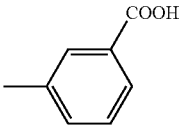 | H | H | H | H | H | H | H |
| A904 | H | H | 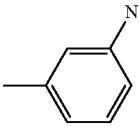 | H | H | H | H | H | H | H |
| A905 | H | H | 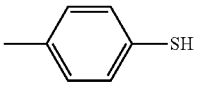 | H | H | H | H | H | H | H |
| A906 | H | H | 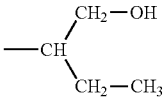 | H | H | H | H | H | H | H |

TABLE 9-continued

| | $R^{91}$ | $R^{92}$ | $R^{93}$ | $R^{94}$ | $R^{95}$ | $R^{96}$ | $R^{97}$ | $R^{98}$ | $R^{99}$ | $R^{100}$ |
|---|---|---|---|---|---|---|---|---|---|---|
| A907 | H | H | COOH | H | H | H | H | H | H | H |
| A908 | H | H | $NH_2$ | H | H | H | H | H | H | H |
| A909 | H | H | $-(CH_2)_3-OH$ | H | H | H | H | H | H | H |
| A910 | H | H | $HOOCH_2C$ 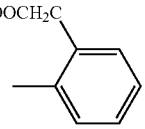 | H | H | H | H | $HOOCH_2C$ 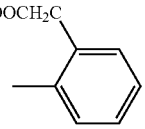 | H | H |

TABLE 10

| | $R^{101}$ | $R^{102}$ | $R^{103}$ | $R^{104}$ | $R^{105}$ | $R^{106}$ | $R^{107}$ |
|---|---|---|---|---|---|---|---|
| A1001 | 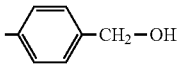 | H | H | H | H | H | H |
| A1002 | 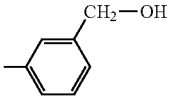 | H | H | H | H | H | H |
| A1003 | 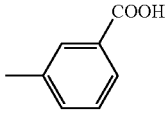 | H | H | H | H | H | H |
| A1004 | 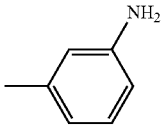 | H | H | H | H | H | H |
| A1005 | 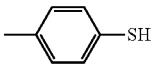 | H | H | H | H | H | H |
| A1006 | 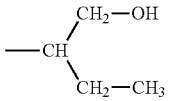 | H | H | H | H | H | H |
| A1007 | COOH | H | H | H | H | H | H |
| A1008 | $NH_2$ | H | H | H | H | H | H |
| A1009 | $-(CH_2)_3-OH$ | H | H | H | H | H | H |

A derivative having the structure represented by Structural Formula (A-1) may be synthesized by the synthesis method described in Japanese Patent Laid-Open No. 1989-206349 or Abstracts of PPCI/Japan Hardcopy '98, 1998, p 207 using, for example, a phenol derivative that is a reagent commercially available from Tokyo Chemical Industry Co., Ltd. or Sigma-Aldrich Japan K.K. as a raw material.

The compound represented by Structural Formula (A-1) has a polymerizable functional group (i.e., hydroxy group, thiol group, amino group, or carboxyl group) that reacts with a crosslinking agent to cause polymerization. Examples of a method for synthesizing the compound represented by Structural Formula (A-1) by introducing a polymerizable functional group to a derivative having the structure represented by Structural Formula (A-1) include the following: a method in which, after a derivative having the structure represented by Structural Formula (A-1) is synthesized, a polymerizable functional group is directly introduced to the derivative; and a method in which, after the synthesis of the derivative, a structure having a polymerizable functional group or a structure having a functional group that serves as a precursor of a polymerizable functional group is introduced to the derivative. Examples of the latter method include the following: a method in which an aryl group having a functional group is introduced to the derivative by a cross-coupling reaction of a diphenoquinone halide using a palladium catalyst and a base; a method in which an alkyl group having a functional group is introduced to the derivative by a cross-coupling reaction of a diphenoquinone halide using a $FeCl_3$ catalyst and a base; and a method in which a hydroxyalkyl group or a carboxyl group is introduced to the derivative by performing lithiation of a diphenoquinone halide and subsequently causing the resulting compound to react with an epoxide or $CO_2$.

A derivative having the structure represented by Structural Formula (A-2) is a reagent commercially available from, for example, Tokyo Chemical Industry Co., Ltd., Sigma-Aldrich Japan K.K., Johnson Matthey Japan G.K. Alternatively, the derivative may be synthesized by the synthesis method described in Tetrahedron Letters, 2002, 43(16), pp 2991-2994 or Tetrahedron Letters, 2003, 44(10), 2087-2091 using a commercially available acenaphthenequinone derivative. A dicyanomethylene group may be introduced by a reaction with malononitrile.

The compound represented by Structural Formula (A-2) has a polymerizable functional group (hydroxy group, thiol group, amino group, carboxyl group) that reacts with a crosslinking agent to cause polymerization. Examples of a method for synthesizing the compound represented by Structural Formula (A-2) by introducing a polymerizable functional group to the derivative having the structure represented by Structural Formula (A-2) include the following: a method in which, after the skeleton represented by Structural Formula (A-2) above is synthesized, a polymerizable functional group is directly introduced to the skeleton; and a method in which, after the synthesis of the skeleton, a structure having a polymerizable functional group or a structure having a functional group that serves as a precursor of a polymerizable functional group is introduced to the skeleton. Examples of the latter method include the following: a method in which an aryl group having a functional group is introduced to the skeleton by a cross-coupling reaction of an acenaphthenequinone halide using a palladium catalyst and a base; a method in which an alkyl group having a functional group is introduced to the skeleton by a cross-coupling reaction of an acenaphthenequinone halide using a $FeCl_3$ catalyst and a base; and a method in which a hydroxyalkyl group or a carboxyl group is introduced to the skeleton by performing lithiation of an acenaphthenequinone halide and then causing the resulting compound to react with an epoxide or $CO_2$.

A derivative having the structure represented by Structural Formula (A-3) is a reagent commercially available from, for example, Tokyo Chemical Industry Co., Ltd., Sigma-Aldrich Japan K.K., or Johnson Matthey Japan G.K. The compound represented by Structural Formula (A-3) has a polymerizable functional group (i.e., hydroxy group, thiol group, amino group, or carboxyl group) that reacts with a crosslinking agent to cause polymerization. An example of a method for synthesizing the compound represented by Structural Formula (A-3) by introducing a polymerizable functional group to the derivative having the structure represented by Structural Formula (A-3) is a method in which a structure having a polymerizable functional group or a structure having a functional group that serves as a precursor of a polymerizable functional group is introduced to a commercially available naphthoquinone derivative. Examples of this method include the following: a method in which an aryl group having a functional group is introduced to the derivative by a cross-coupling reaction of a naphthoquinone halide using a palladium catalyst and a base; a method in which an alkyl group having a functional group is introduced to the derivative by a cross-coupling reaction of a naphthoquinone halide using a $FeCl_3$ catalyst and a base; and a method in which a hydroxyalkyl group or carboxyl group is introduced to the derivative by performing lithiation of a naphthoquinone halide and then causing the resulting compound to react with an epoxide or $CO_2$.

A derivative having the structure represented by Structural Formula (A-4) may be synthesized by a publicly known synthesis method such as those described in U.S. Pat. Nos. 4,442,193, 4,992,349, 5,468,583, Chemistry of Materials, 2007, Vol. 19, No. 11, pp 2703-2705, and Journal of the Imaging Society of Japan, 2006, Vol. 45, No. 6, pp 521-525. A derivative having the structure represented by Structural Formula (A-4) may be synthesized by a reaction between naphthalenetetracarboxylic dianhydride and a monoamine derivative, which are commercially available from Tokyo Chemical Industry Co., Ltd., Sigma-Aldrich Japan K.K., or Johnson Matthey Japan G.K.

The compound represented by Structural Formula (A-4) has a polymerizable functional group (i.e., hydroxy group, thiol group, amino group, or carboxyl group) that reacts with a crosslinking agent. Examples of a method for synthesizing the compound represented by Structural Formula (A-4) by introducing a polymerizable functional group to the derivative having the structure represented by Structural Formula (A-4) include the following: a method in which a polymerizable functional group is directly introduced to the derivative having the structure represented by Structural Formula (A-4); and a method in which a structure having a polymerizable functional group or a structure having a functional group that serves as a precursor of a polymerizable functional group is introduced to the derivative. Examples of the latter method include the following: a method in which an aryl group having a functional group is introduced to the derivative by a cross-coupling reaction of a halide of a naphthylimide derivative using a palladium catalyst and a base; a method in which an alkyl group having a functional group is introduced to the derivative by a cross-coupling reaction of a halide of naphthylimide derivative using a $FeCl_3$ catalyst and a base; and a method in which a hydroxyalkyl group or a carboxyl group is introduced to the derivative by performing lithiation of a halide of a naphthylimide derivative and then causing the resulting compound to react with an epoxide or $CO_2$. The naphthylimide derivative may be synthesized using, as a raw material, a naphthalenetetracarboxylic dianhydride derivative or a monoamine derivative having a polymerizable functional group or a functional group that serves as a precursor of a polymerizable functional group.

A derivative having the structure represented by Structural Formula (A-5) is commercially available from, for example, Tokyo Chemical Industry Co., Ltd., Sigma-Aldrich Japan K.K., or Johnson Matthey Japan G.K. The derivative may also be synthesized using a commercially available phenanthrene derivative or phenanthroline derivative as a starting material by the synthesis method described in The Chemical Educator, 2001, No. 6, pp 227-234, Journal of Synthetic Organic Chemistry, Japan, 1957, Vol. 15, pp 29-32, or Journal of Synthetic Organic Chemistry, Japan, 1957, Vol. 15, pp 32-34. A dicyanomethylene group may be introduced by a reaction with malononitrile.

The compound represented by Structural Formula (A-5) has a polymerizable functional group (i.e., hydroxy group, thiol group, amino group, or carboxyl group) that reacts with a crosslinking agent. Examples of a method for synthesizing the compound represented by Structural Formula (A-5) by introducing a polymerizable functional group to a derivative having the structure represented by Structural Formula (A-5) include the following: a method in which a polymerizable functional group is directly introduced to the derivative having the structure represented by Structural Formula (A-5); and a method in which a structure having a polymerizable functional group or a structure having a functional group that serves as a precursor of a polymerizable functional group is introduced to the derivative. Examples of the latter method include the following: a method in which an aryl group having a functional group is introduced to the derivative by a cross-coupling reaction of a phenanthrenequinone halide using a palladium catalyst and a base; a method in which an alkyl group having a functional group is introduced to the derivative by a cross-coupling reaction of a phenanthrenequinone halide using a $FeCl_3$ catalyst and a base; and a method in which a hydroxy alkyl group or a carboxyl group is introduced to the derivative by performing lithiation of a phenanthrenequinone halide and subsequently causing the resulting compound to react with an epoxide or $CO_2$.

A derivative having the structure represented by Structural Formula (A-6) is commercially available from, for example, Tokyo Chemical Industry Co., Ltd., Sigma-Aldrich Japan K.K., or Johnson Matthey Japan G.K. The derivative may also be synthesized using a commercially available phenanthrene derivative or phenanthroline derivative as a starting material by the method described in Bulletin of the Chemical Society of Japan, 1992, Vol. 65, pp 1006-1011. A dicyanomethylene group may be introduced by a reaction with malononitrile.

The compound represented by Structural Formula (A-6) has a polymerizable functional group (i.e., hydroxy group, thiol group, amino group, or carboxyl group) that reacts with a crosslinking agent. Examples of a method for synthesizing the compound represented by Structural Formula (A-6) by introducing a polymerizable functional group to the derivative having the structure represented by Structural Formula (A-6) include the following: a method in which a polymerizable functional group is directly introduced to the derivative having the structure represented by Structural Formula (A-6); and a method in which a structure having a polymerizable functional group or a structure having a functional group that serves as a precursor of a polymerizable functional group is introduced to the derivative. Examples of the latter method include the following: a method in which an aryl group having a functional group is introduced to the derivative by a cross-coupling reaction of a phenanthrolinequinone halide using a palladium catalyst and a base; a method in which an alkyl group having a functional group is introduced by a cross-coupling reaction of a phenanthrolinequinone halide using a $FeCl_3$ catalyst and a base; and a method in which a hydroxyalkyl group or a carboxyl group is introduced to the derivative by performing lithiation of a phenanthrolinequinone halide and subsequently causing the resulting compound to react with an epoxide or $CO_2$.

A derivative having the structure represented by Structural Formula (A-7) is commercially available from, for example, Tokyo Chemical Industry Co., Ltd., Sigma-Aldrich Japan K.K., or Johnson Matthey Japan G.K. The derivative may also be synthesized by the synthesis method described in U.S. Pat. No. 4,562,132 using a commercially available fluorenone derivative and malononitrile. Alternatively, the derivative may be synthesized by the synthesis method described in Japanese Patent Laid-Open No. 1993-279582 or Japanese Patent Laid-Open No. 1995-70038 using a commercially available fluorenone derivative and an aniline derivative.

The compound represented by Structural Formula (A-7) has a polymerizable functional group (i.e., hydroxy group, thiol group, amino group, or carboxyl group) that reacts with a crosslinking agent. Examples of a method for synthesizing the compound represented by Structural Formula (A-7) by introducing a polymerizable functional group to the derivative having the structure represented by Structural Formula (A-7) include the following: a method in which a polymerizable functional group is directly introduced to the derivative having the structure represented by Structural Formula (A-7); and a method in which a structure having a polymerizable functional group or a structure having a functional group that serves as a precursor of a polymerizable functional group is introduced to the derivative. Examples of the latter method include the following: a method in which an aryl group having a functional group is introduced to the derivative by a cross-coupling reaction of a fluorenone halide using a palladium catalyst and a base; a method in which an alkyl group having a functional group is introduced to the derivative by a cross-coupling reaction of a fluorenone halide using a $FeCl_3$ catalyst and a base; and a method in which a hydroxyalkyl group or a carboxyl group is introduced to the derivative by performing lithiation of a fluorenone halide and subsequently causing the resulting compound to react with an epoxide or $CO_2$.

A derivative having the structure represented by Structural Formula (A-8) is commercially available from, for example, Tokyo Chemical Industry Co., Ltd., Sigma-Aldrich Japan K.K., or Johnson Matthey Japan G.K.

The compound represented by Structural Formula (A-8) has a polymerizable functional group (i.e., hydroxy group, thiol group, amino group, or carboxyl group) that reacts with a crosslinking agent. An example of a method for synthesizing the compound represented by Structural Formula (A-8) by introducing a polymerizable functional group to the derivative having the structure represented by Structural Formula (A-8) is a method in which a structure having a polymerizable functional group or a structure having a functional group that serves as a precursor of a polymerizable functional group is introduced to a commercially available anthraquinone derivative. Examples of such a method include the following: a method in which an aryl group having a functional group is introduced to the derivative by a cross-coupling reaction of an anthraquinone halide using a palladium catalyst and a base; a method in which an alkyl group having a functional group is introduced to the derivative by a cross-coupling reaction of an anthraquinone halide using a $FeCl_3$ catalyst and a base; and a method in which a hydroxyalkyl group or a carboxyl group is introduced to the derivative by performing lithiation of an anthraquinone halide and subsequently causing the resulting compound to react with an epoxide or $CO_2$.

A derivative having the structure represented by Structural Formula (A-9) may be synthesized by the publicly known synthesis method described in, for example, Journal of the American Chemical Society, 2007, Vol. 129, No. 49, pp 15259-15278. The derivative may be synthesized by, for example, reacting perylenetetracarboxylic dianhydride with a monoamine derivative, which are reagents commercially available from Tokyo Chemical Industry Co., Ltd., Sigma-Aldrich Japan K.K., or Johnson Matthey Japan G.K.

The compound represented by Structural Formula (A-9) has a polymerizable functional group (i.e., hydroxy group, thiol group, amino group, or carboxyl group) that reacts with a crosslinking agent. Examples of a method for synthesizing the compound represented by Structural Formula (A-9) by introducing a polymerizable functional group to the derivative having the structure represented by Structural Formula (A-9) include the following: a method in which a polymerizable functional group is directly introduced to the derivative having the structure represented by Structural Formula (A-9); and a method in which a structure having a polymerizable functional group or a structure having a functional group that serves as a precursor of a polymerizable functional group is introduced to the derivative. Examples of the latter method include the following: a method in which a cross-coupling reaction of a halide of peryleneimide derivative is performed using a palladium catalyst and a base; and a method in which a cross-coupling reaction of a halide of peryleneimide derivative is performed using a $FeCl_3$ catalyst and a base. The peryleneimide derivative may be synthesized using, as a raw material, a perylenetetracarboxylic dianhydride derivative or a monoamine derivative having a polymerizable functional group or a functional group that serves as a precursor of a polymerizable functional group.

A derivative having the structure represented by Structural Formula (A-10) may be synthesized by the publicly known synthesis method described in Japanese Patent Laid-Open No. 1993-27470. The derivative may be synthesized by reacting naphthalenedicarboxylic anhydride with a monoamine derivative, which are commercially available from, for example, Tokyo Chemical Industry Co., Ltd., Sigma-Aldrich Japan K.K., or Johnson Matthey Japan G.K.

The compound represented by Structural Formula (A-10) has a polymerizable functional group (i.e., hydroxy group, thiol group, amino group, or carboxyl group) that reacts with a crosslinking agent. Examples of a method for synthesizing the compound represented by Structural Formula (A-10) by introducing a polymerizable functional group to the derivative having the structure represented by Structural Formula (A-10) include the following: a method in which a polymerizable functional group is directly introduced to the derivative having the structure represented by Structural Formula (A-10); and a method in which a structure having a polymerizable functional group or a structure having a functional group that serves as a precursor of a polymerizable functional group is introduced to the derivative. Examples of the latter method include the following: a method in which an aryl group having a functional group is introduced to the derivative by a cross-coupling reaction of a halide of a naphthylimide derivative using a palladium catalyst and a base; a method in which an alkyl group having a functional group is introduced to the derivative by a cross-coupling reaction of a halide of a naphthylimide derivative using a $FeCl_3$ catalyst and a base; and a method in which a hydroxyalkyl group or a carboxyl group is introduced to the derivative by performing lithiation of a halide of a naphthylimide derivative and subsequently causing the resulting compound to react with an epoxide or $CO_2$. The naphthylimide derivative may be synthesized using, as a raw material, a naphthalenetetracarboxylic dianhydride derivative or a monoamine derivative having a polymerizable functional group or a functional group that serves as a precursor of a polymerizable functional group.

Crosslinking Agent

The crosslinking agent is described below. The crosslinking agent may be a compound that reacts with both the electron transporting substance having a polymerizable functional group and a resin having a polymerizable functional group to cause polymerization or crosslinking. Specific examples of such a compound include the compounds described in Kakyo-zai Handbook, Shinzo Yamashita and Tosuke Kaneko, 1981, published by Taisei-sha. For example, an isocyanate compound and an amino compound may be used as a crosslinking agent.

The isocyanate compound preferably has three to six isocyanate groups or three to six blocked isocyanate groups. The molecular weight of the isocyanate compound is preferably 200 to 1,300.

The blocked isocyanate group is a group having a structure of —NHCO$X^1$, where $X^1$ represents a protecting group. $X^1$ is not limited as long as it is a protecting group capable of being introduced to an isocyanate group. However, $X^1$ is preferably one of the groups represented by Structural Formulae (H1) to (H7) below.

(H1)

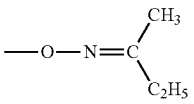

(H2)

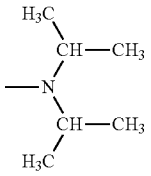

-continued (H3)

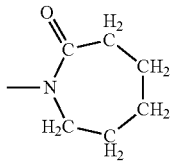

(H4)

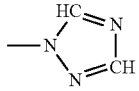

(H5)

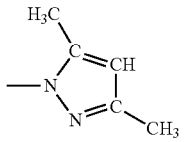

(H6)

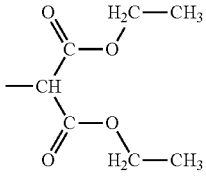

(H7)

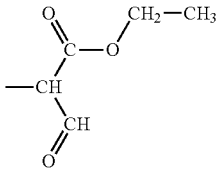

Examples of the isocyanate compound include modified diisocyanates such as an isocyanurate-modified diisocyanate, a biuret-modified diisocyanate, an allophanate-modified diisocyanate, a trimethylolpropane-adduct-modified diisocyanate, and a pentaerythritol-adduct-modified diisocyanate, that is, triisocyanate benzene, triisocyanate methylbenzene, triphenylmethane triisocyanate, lysine triisocyanate, tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate, and norbornane diisocyanate.

Specific examples of the isocyanate compound include the following:

(B1)

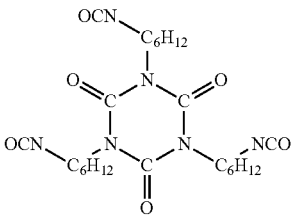

(B2)

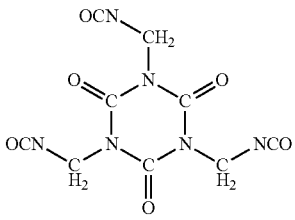

-continued
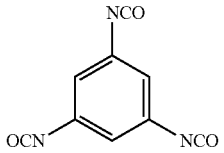
(B3)
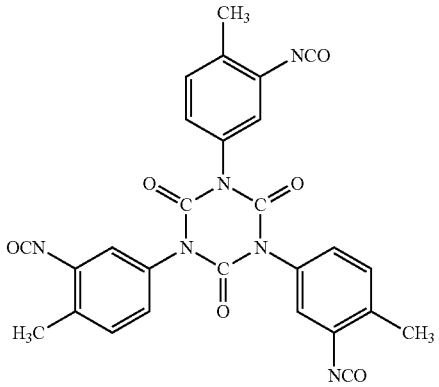
(B4)
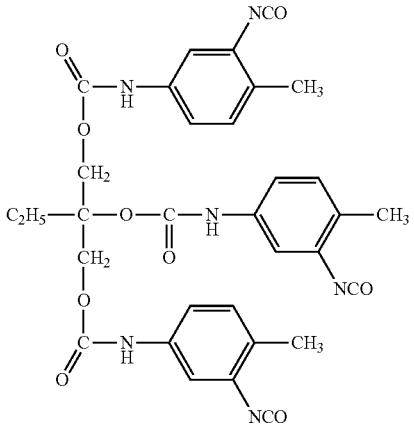
(B5)
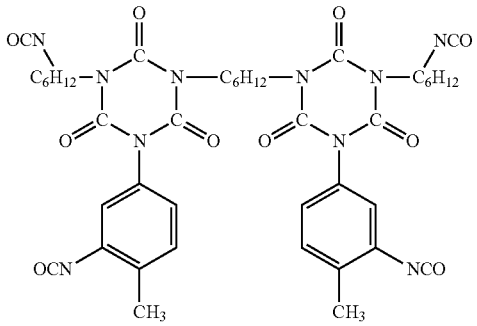
(B6)
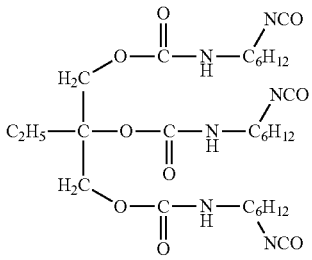
(B7)
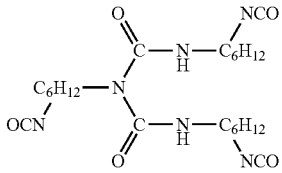
(B8)
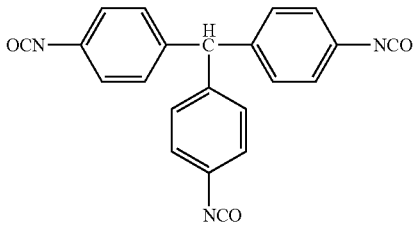
(B9)
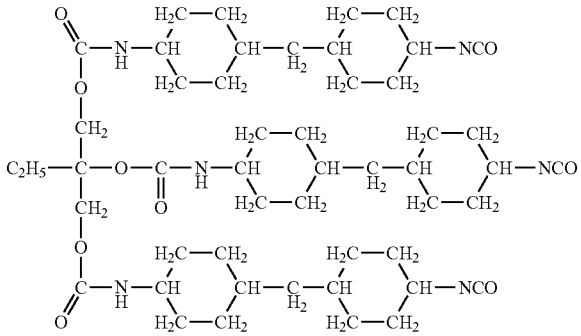
(B10)

-continued
(B11)
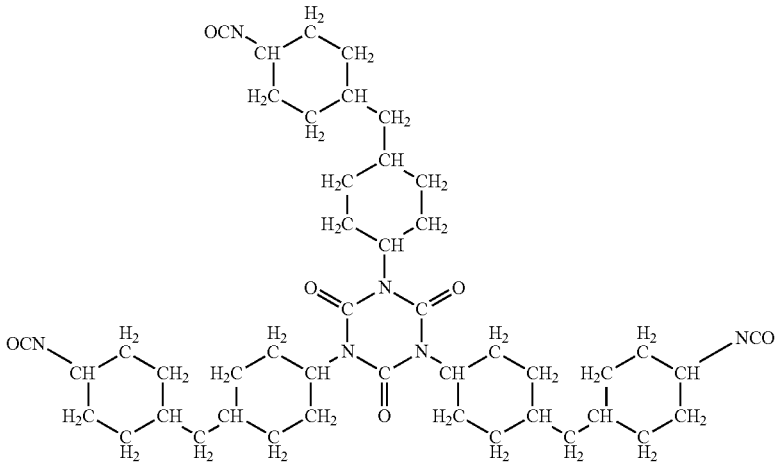
(B12)
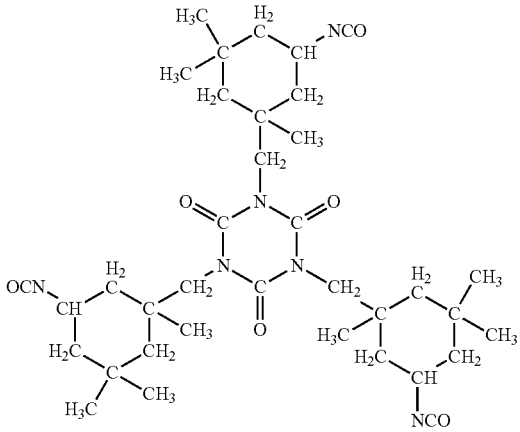
(B13)
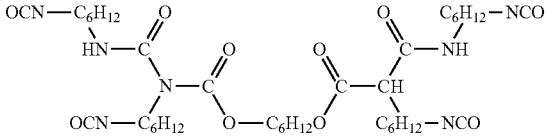
(B14)
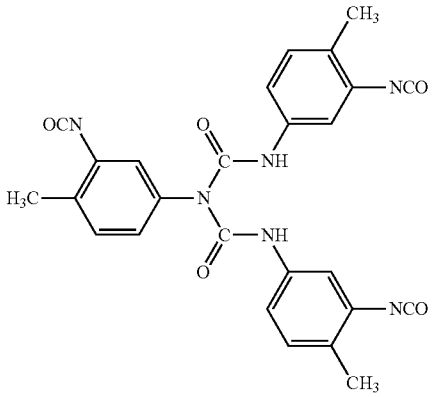
(B15)
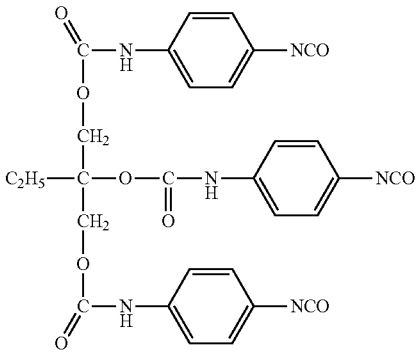

-continued
(B16)
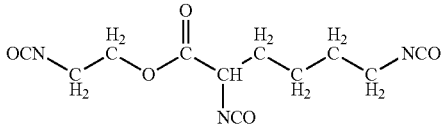
(B17)
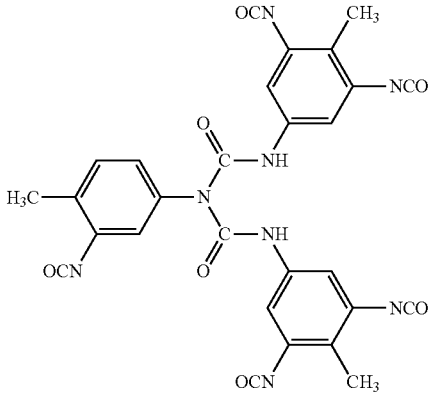
(B18)
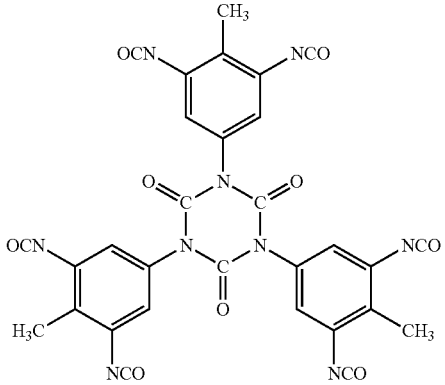
(B19)
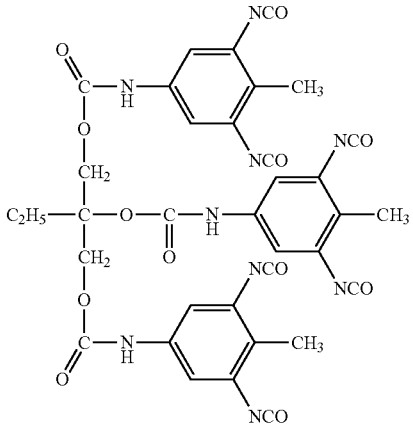
(B20)
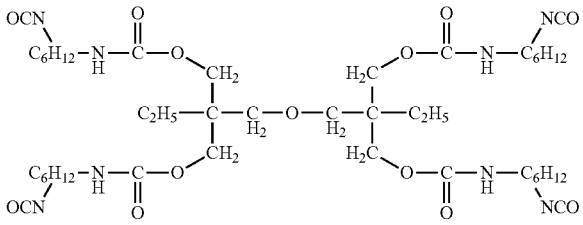
(B21)
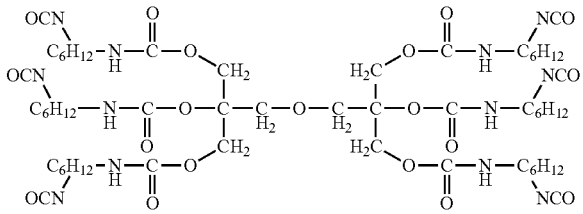
The amine compound is preferably a compound represented by one of Structural Formulae (C1) to (C5) or an oligomer of a compound represented by one of Structural Formulae (C1) to (C5). The molecular weight of the amine compound is preferably 200 to 1,000. The amine compound preferably has three to six monovalent groups represented by $—CH_2—OR^1$.
(C1)
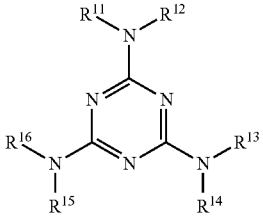
-continued
(C2)
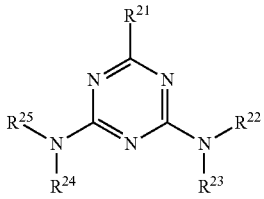
(C3)
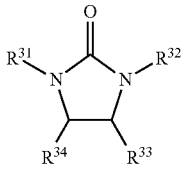

-continued (C4)

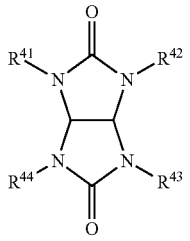

(C5)

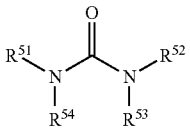

In Structural Formulae (C1) to (C5), $R^{11}$ to $R^{16}$, $R^{22}$ to $R^{25}$, $R^{31}$ to $R^{34}$, $R^{41}$ to $R^{44}$, and $R^{51}$ to $R^{54}$ each independently represent a hydrogen atom, a hydroxy group, an acyl group, or a monovalent group represented by —$CH_2$—$OR^1$; and at least one of $R^{11}$ to $R^{16}$, at least one of $R^{22}$ to $R^{25}$, at least one of $R^{31}$ to $R^{34}$, at least one of $R^{41}$ to $R^{44}$, and at least one of $R^{51}$ to $R^{54}$ are a monovalent group represented by —$CH_2$—$OR^1$, where $R^1$ represents a hydrogen atom or an alkyl group having 1 to 10 carbon atoms. The alkyl group is preferably a methyl group, an ethyl group, a propyl group (n-propyl group or iso-propyl group), or a butyl group (n-butyl group, iso-butyl group, or tert-butyl group) from the viewpoint of polymerizability. In Structural Formula (C2), $R^{21}$ represents an aryl group, an aryl group substituted by an alkyl group, a cycloalkyl group, or a cycloalkyl group substituted by an alkyl group.

Specific examples of the compound represented by one of Structural Formulae (C1) to (C5) include the following. However, the amine compound may be an oligomer (multimer) of the compound represented by one of Structural Formulae (C1) to (C5). The above-described oligomer and monomer may be used in combination of two or more.

Examples of commercially available compounds represented by Structural Formula (C1) include SUPER MELAMI No. 90 (produced by NOF CORPORATION); Super Beckamine (R) TD-139-60, L-105-60, L127-60, L110-60, J-820-60, and G-821-(produced by DIC Corporation); U-VAN 2020 (produced by Mitsui Chemicals, Inc.); Sumitex Resin M-3 (Sumitomo Chemical Co., Ltd.); and NIKALAC MW-30, MW-390, and MX-750LM (produced by NIPPON CARBIDE INDUSTRIES CO., INC.). Examples of commercially available compounds represented by Structural Formula (C2) include Super Beckamine (R) L-148-55, 13-535, L-145-60, and TD-126 (produced by DIC Corporation); and NIKALAC BL-60 and BX-4000 (produced by NIPPON CARBIDE INDUSTRIES CO., INC.). An example of commercially available compounds represented by Structural Formula (C3) is NIKALAC MX-280 (produced by NIPPON CARBIDE INDUSTRIES CO., INC.). An example of commercially available compounds represented by Structural Formula (C4) is NIKALAC MX-270 (produced by NIPPON CARBIDE INDUSTRIES CO., INC.). An example of commercially available compounds represented by Structural Formula (C5) is NIKALAC MX-290 (produced by NIPPON CARBIDE INDUSTRIES CO., INC.).

Specific examples of the compound represented by one of Structural Formulae (C1) to (C5) include the following.

(C1-1)

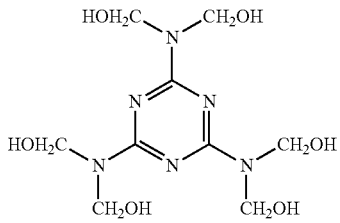

(C1-2)

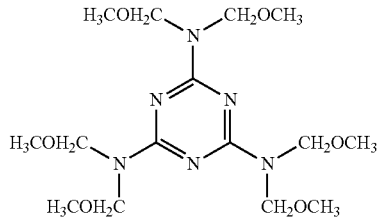

(C1-3)

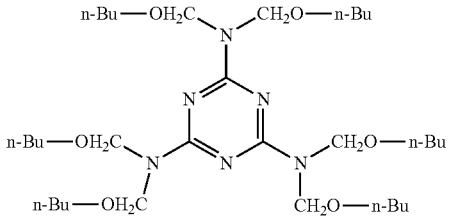

(C1-4)

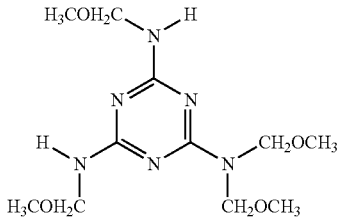

(C1-5)

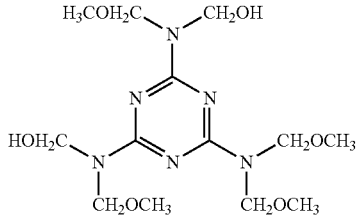

(C1-6)

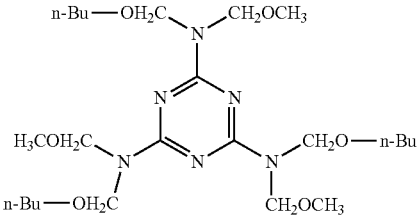

(C1-7)

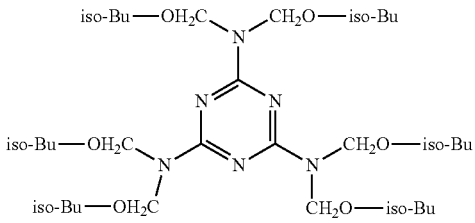

-continued
(C1-8)
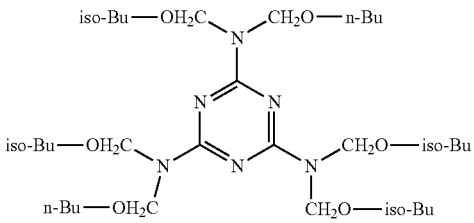
(C1-9)
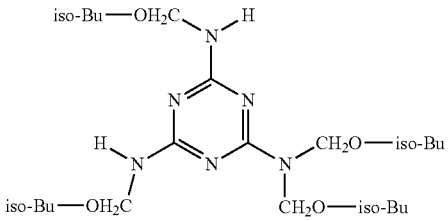
(C1-10)
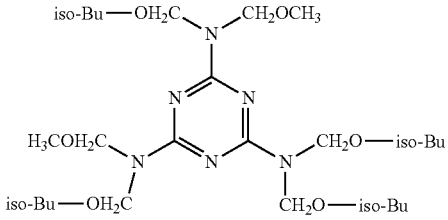
(C1-11)
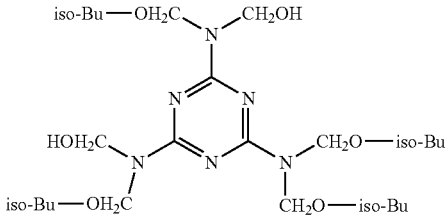
(C1-12)
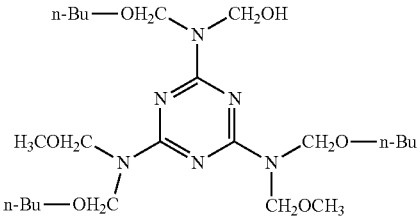
(C2-1)
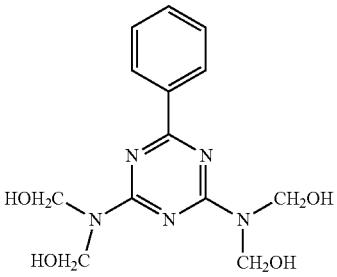
-continued
(C2-2)
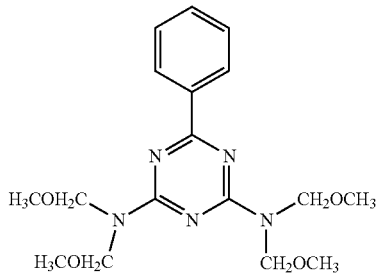
(C2-3)
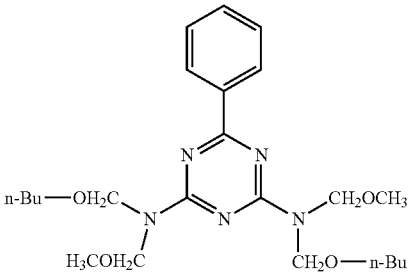
(C2-4)
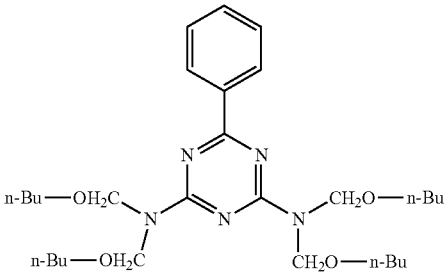
(C2-5)
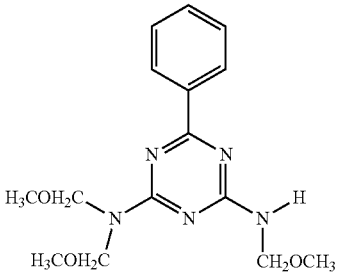
(C2-7)
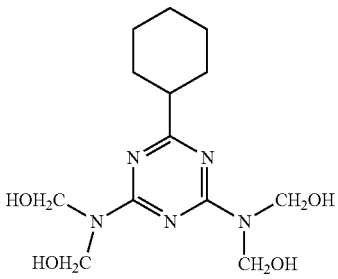

-continued
(C2-8)
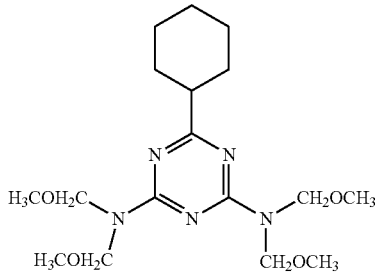
(C2-9)
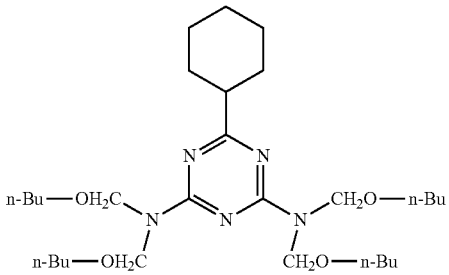
(C2-10)
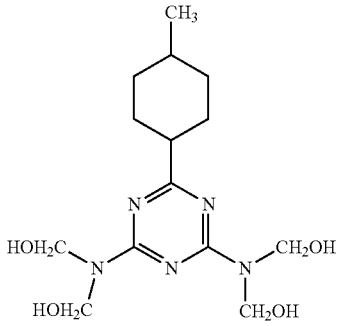
(C2-11)
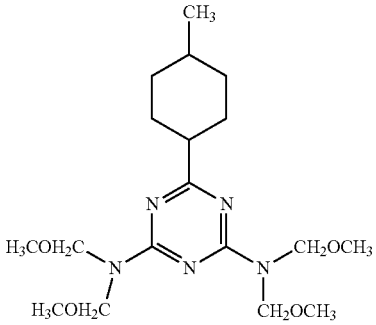
(C2-12)
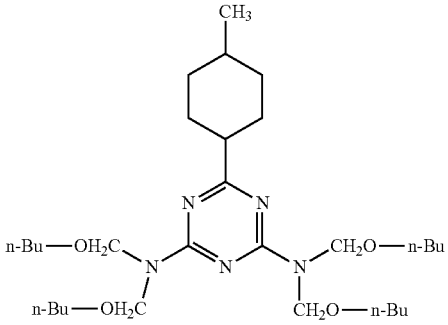
-continued
(C2-13)
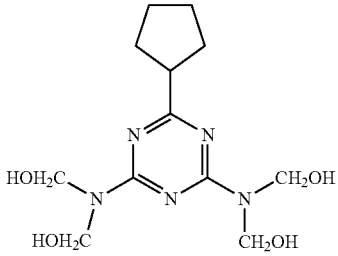
(C2-14)
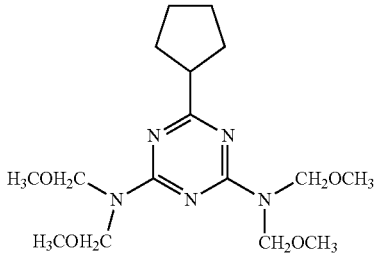
(C2-15)
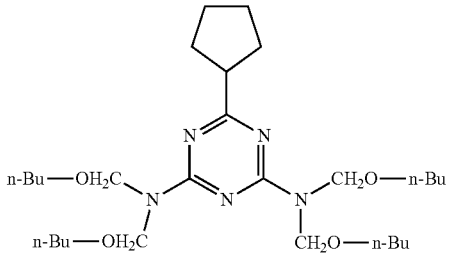
(C2-16)
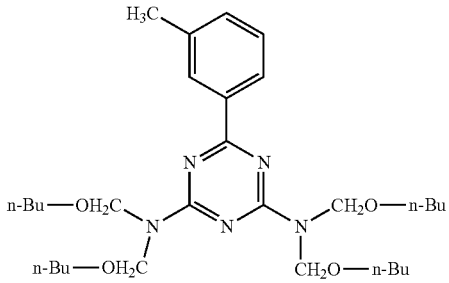
(C2-17)
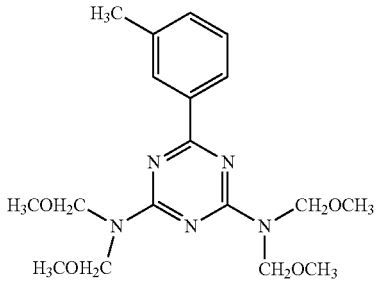

-continued
(C2-18)
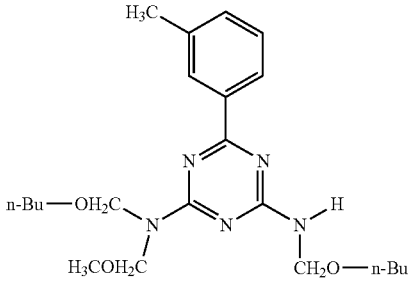
(C3-1)
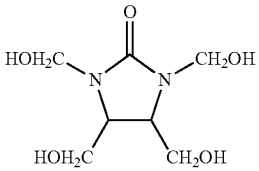
(C3-2)
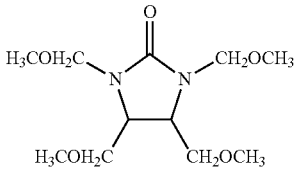
(C3-3)
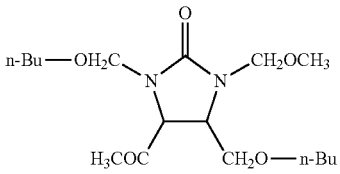
(C3-4)
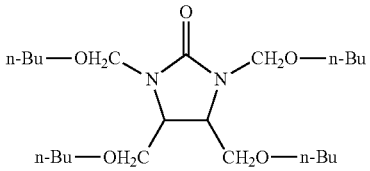
(C3-5)
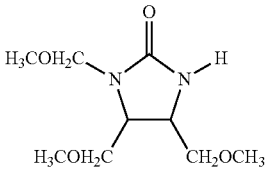
(C3-6)
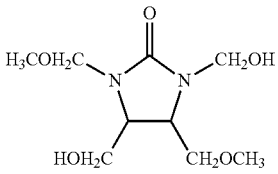
(C4-1)
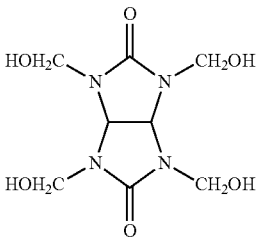
-continued
(C4-2)
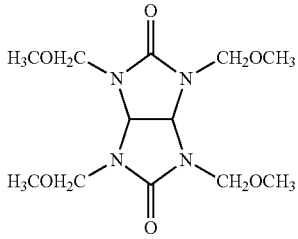
(C4-3)
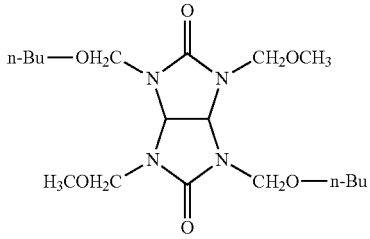
(C4-4)
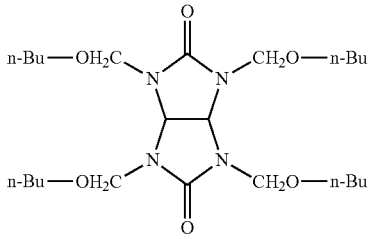
(C4-5)
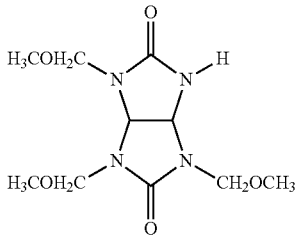
(C4-6)
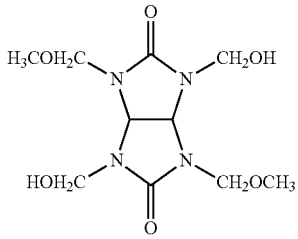
(C5-1)
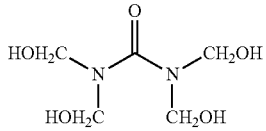
(C5-2)
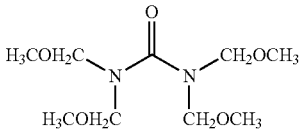

-continued (C5-3)

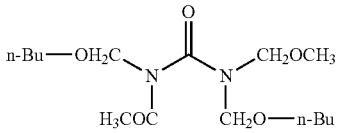

(C5-4)

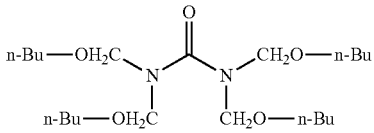

(C5-5)

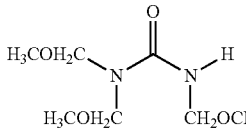

(C5-6)

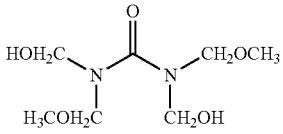

Resin

The resin having a polymerizable functional group is described below. An example of the resin having a polymerizable functional group is a resin having the structural unit represented by Structural Formula (D) below.

(D)

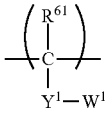

In Structural Formula (D), $R^{61}$ represents a hydrogen atom or an alkyl group; $Y^1$ represents a single bond, an alkylene group, or a phenylene group; and $W^1$ represents a hydroxy group, a thiol group, an amino group, or a carboxyl group.

Examples of the resin having the structural unit represented by Structural Formula (D) include an acetal resin, a polyolefin resin, a (poly)ester resin, a polyether resin, and a polyamide resin. The structural unit represented by Structural Formula (D) above may be included in the following characteristic structures or may be outside the following characteristic structures. Structural Formula (E-1) represents the structural unit of an acetal resin. Structural Formula (E-2) represents the structural unit of a polyolefin resin. Structural Formula (E-3) represents the structural unit of a (poly)ester resin. Structural Formula (E-4) represents the structural unit of a polyether resin. Structural Formula (E-5) represents the structural unit of a polyamide resin.

(E-1)

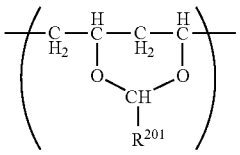

-continued (E-2)

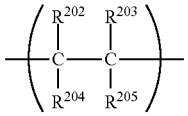

(E-3)

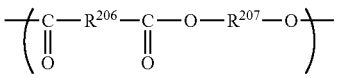

(E-4)

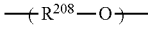

(E-5)

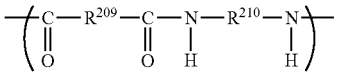

In the Structural Formulae (E-1) to (E-5) above, $R^{201}$ to $R^{205}$ each independently represent a substituted or unsubstituted alkyl group or a substituted or unsubstituted aryl group; and $R^{206}$ to $R^{210}$ each independently represent a substituted or unsubstituted alkylene group or a substituted or unsubstituted arylene group. When $R^{201}$ is $C_3H_7$, Structural Formula (E-1) represents butyral.

The resin having the structural unit represented by Structural Formula (D) (hereinafter, also referred to as "Resin D") may be obtained by polymerization of a monomer having a polymerizable functional group which is commercially available from, for example, Sigma-Aldrich Japan K.K. or Tokyo Chemical Industry Co., Ltd.

Examples of commercially available resins that serve as the resin D include polyether polyol resins such as AQD-457 and AQD-473 (produced by Nippon Polyurethane Industry Co., Ltd.) and SANNIX GP-400 and GP-700 (produced by Sanyo Chemical Industries, Ltd.); polyester polyol resins such as Phtalkyd W2343 (produced by Hitachi Chemical Co., Ltd.), WATERSOL S-118, CD-520, BECKOLITE M-6402-50, M-6201-401M (produced by DIC Corporation), HARIDIP WH-1188 (produced by Harima Chemicals Group, Inc.), ES3604 and ES6538 (produced by Japan U-pica Co., Ltd.); polyacryl polyol resins such as BURNOCK WE-300, WE-304 (produced by DIC Corporation); polyvinyl alcohol resins such as KURARAY POVAL PVA-203 (produced by Kuraray Co., Ltd.); polyvinyl acetal resins such as BX-1, BM-1 (produced by SEKISUI CHEMICAL CO., LTD.); polyamide resins such as Toresin FS-350 (produced by Nagase ChemteX Corporation); carboxyl-group-containing resins such as Aquarick (produced by NIPPON SHOKUBAI CO., LTD.) and FINELEX SG2000 (produced by Namariichi Co., Ltd.); polyamine resins such as LUCKAMIDE (produced by DIC Corporation); and polythiol resins such as QE-340M (produced by Toray Industries, Inc.). Among the above-described resins, polyvinyl acetal resins and polyester polyol resins are more preferably used from the viewpoints of polymerizability and film uniformity.

The weight-average molecular weight (Mw) of the resin having the structural unit represented by Structural Formula (D) is more preferably 5,000 to 400,000.

Table 11 shows specific examples of the resin D. However, the present invention is not limited to these examples. In Table 11, the column of "Characteristic structure" shows a structural unit included in the resin which is represented by any one of Structural Formulae (E-1) to (E-5).

TABLE 11

| | Structure | | | Number of moles of functional groups | Characteristic | Weight-average molecular |
|---|---|---|---|---|---|---|
| | $R^{61}$ | $Y^1$ | $W^1$ | per gram | structure | weight |
| D1 | H | Single bond | OH | 3.3 mmol | Butyral | $1 \times 10^5$ |
| D2 | H | Single bond | OH | 3.3 mmol | Butyral | $4 \times 10^4$ |
| D3 | H | Single bond | OH | 3.3 mmol | Butyral | $2 \times 10^4$ |
| D4 | H | Single bond | OH | 1.0 mmol | Polyolefin | $1 \times 10^5$ |
| D5 | H | Single bond | OH | 3.0 mmol | Ester | $8 \times 10^4$ |
| D6 | H | Single bond | OH | 2.5 mmol | Polyether | $5 \times 10^4$ |
| D7 | H | Single bond | OH | 2.8 mmol | Cellulose | $3 \times 10^4$ |
| D8 | H | Single bond | COOH | 3.5 mmol | Polyolefin | $6 \times 10^4$ |
| D9 | H | Single bond | $NH^2$ | 1.2 mmol | Polyamide | $2 \times 10^5$ |
| D10 | H | Single bond | SH | 1.3 mmol | Polyolefin | $9 \times 10^3$ |
| D11 | H | Phenylene | OH | 2.8 mmol | Polyolefin | $4 \times 10^3$ |
| D12 | H | Single bond | OH | 3.0 mmol | Butyral | $7 \times 10^4$ |
| D13 | H | Single bond | OH | 2.9 mmol | Polyester | $2 \times 10^4$ |
| D14 | H | Single bond | OH | 2.5 mmol | Polyester | $6 \times 10^3$ |
| D15 | H | Single bond | OH | 2.7 mmol | Polyester | $8 \times 10^4$ |
| D16 | H | Single bond | COOH | 1.4 mmol | Polyolefin | $2 \times 10^5$ |
| D17 | H | Single bond | COOH | 2.2 mmol | Polyester | $9 \times 10^3$ |
| D18 | H | Single bond | COOH | 2.8 mmol | Polyester | $8 \times 10^2$ |
| D19 | $CH_3$ | Alkylene | OH | 1.5 mmol | Polyester | $2 \times 10^4$ |
| D20 | $C_2H_5$ | Alkylene | OH | 2.1 mmol | Polyester | $1 \times 10^4$ |
| D21 | $C_2H_5$ | Alkylene | OH | 3.0 mmol | Polyester | $5 \times 10^4$ |
| D22 | H | Single bond | $OCH_3$ | 2.8 mmol | Polyolefin | $7 \times 10^3$ |
| D23 | H | Single bond | OH | 3.3 mmol | Butyral | $2.7 \times 10^5$ |
| D24 | H | Single bond | OH | 3.3 mmol | Butyral | $4 \times 10^5$ |
| D25 | H | Single bond | OH | 2.5 mmol | Acetal | $3.4 \times 10^5$ |

Particles Including Titanium Oxide

The undercoat layer (in the case where the undercoat layer has a laminated structure, the first undercoat layer) includes particles including titanium oxide. Examples of the particles including titanium oxide include titanium oxide particles and titanium oxide particles coated with a metal oxide. Optionally, the particles may be surface-treated. Examples of the metal oxide used for coating the titanium oxide particles include zinc oxide, titanium oxide, tin oxide, indium oxide, and zirconium oxide. The surface-treating agent may be selected from publicly known surface-treating agents. Specific examples thereof include a silane coupling agent, a titanate-based coupling agent, an aluminium-based coupling agent, and a surfactant. The surface treatment may be performed by a publicly known method such as a dry process or a wet process.

The number-average particle diameter of the particles including titanium oxide is preferably 0.1 μm or more and 1.0 μm or less in order to suppress occurrence of interference fringes. In order to enhance a capability of shielding the support, such particles may be used in combination with other particle including titanium oxide which have a number-average particle diameter of less than 0.1 μm. The crystal structure of titanium oxide is preferably a rutile-type crystal structure or an anatase-type crystal structure and is more preferably a rutile-type crystal structure.

Examples of the titanium oxide particles having a number-average particle diameter of 0.1 μm or more and 1.0 μm or less include JR-301, JR-403, JR-405, JR-600A, JR-605, JR-600E, JR-603, JR-805, JR-806, JR-701, JRNC, JR-800, JR-1000, JA-1, JA-C, JA-3, and TITANIXJA-1 (produced by TAYCA CORPORATION); R-550, R-580, R-630, R-670, R-680, R-780, R-780-2, R-820, R-830, R-850, R-855, R-930, R-980, CR-50, CR-50-2, CR-57, CR-58, CR-58-2, CR-60, CR-60-2, CR-63, CR-67, CR-Super70, CR-80, CR-85, CR-90, CR-90-2, CR-93, CR-95, CR-953, CR-97, CR-EL, PC-3, S-305, PF-690, PF-691, PF-711, PF-736, PF-737, PF-739, PF-740, PF-742, PT-301, PT-501A, PT-501R, UT771, A-100, A-220, W-10, and ST-41 (produced by ISHIHARA SANGYO KAISHA, LTD.); and SR-1, R-42, R-45M, R-650, R-32, R-5N, GTR-100, R-62N, R-7E, R-3L, R-11P, R-21, R-25, TCR-52, R-310, D-918, FTR-700, R-39, FPT-1, A-110, TCA-123E, A-190, A-197, SA-1, and SA-1L (produced by Sakai Chemical Industry Co., Ltd.).

Examples of the titanium oxide particles having a number-average particle diameter of less than 0.1 μm include MT-01, MT-10EX, MT-05, MT-150A, MT-100S, MT-100TV, MT-100Z, MT-150EX, MT-150 W, MT-100AQ, MT-100WP, MT-100SA, MT-100HD, MT-300HD, MT-500HD, MT-500B, MT-500SA, MT-600B, MT-600SA, MT-700B, MT-700HD, MTY-02, MTY-110M3S, MT-500SAS, MTY-700BS, JMT-1501B, JMT-150AO, JMT-150FI, JMT-150ANO, AMT-100, AMT-600, TKP-101, and TKP-102 (produced by TAYCA CORPORATION); and TTO-51(A), TTO-51(C), TTO-55(A), TTO-55(B), TTO-55(C), TTO-55(D), TTO-F-2, TTO-F-6, ST-01, ST-21, ST-31, ST-30L, PT-401M, MC-50, MC-90, and MC-150 (produced by ISHIHARA SANGYO KAISHA, LTD).

The titanium oxide particles may be used in the form of sol or slurry. Examples thereof include TKS-201, TKS-202, TKS-203, TKD-701, TKD-702, TKD-801, and TKD-802 (produced by TAYCA CORPORATION); and TTO-W-5, STS-01, STS-02, STS-21, and STS-100 (produced by ISHIHARA SANGYO KAISHA, LTD.).

In addition to the cured product having electron transportability and the particles including titanium oxide, publicly known materials used for forming an undercoat layer, such as a resin, organic resin particles, inorganic particles, a leveling agent, or a catalyst for promoting curing, may be further added to the undercoat layer in order to enhance film formability and electrophotographic characteristics. The total content of the particles including titanium oxide and the cured product having electron transportability in the undercoat layer is preferably 40% by mass or more and 80% by mass or less of the whole mass of the undercoat layer. In the case where the undercoat layer has a laminated structure, the total content of the particles including titanium oxide and the cured product having electron transportability is preferably 40% by mass or more and 80% by mass or less of the whole mass of the undercoat layer, that is, the total mass of the first undercoat layer and the second undercoat layer. In order to enhance the effect of suppressing the occurrence of black dots, the content of the cured product having electron transportability in the undercoat layer is preferably 10% by mass or more and 70% by mass or less of the total mass of the cured product having electron transportability and the particles including titanium oxide. In the case where the undercoat layer has a laminated structure, in the first undercoat layer and the second undercoat layer, the total content of the cured product having electron transportability is preferably 10% by mass or more and 70% by mass or less of the total mass of the cured product having electron transportability and the particles including titanium oxide.

The undercoat layer may be a single-layer undercoat layer or may be a laminated undercoat layer constituted by a first undercoat layer and a second undercoat layer formed on the first undercoat layer. In the case where the undercoat layer has a single-layer structure, the undercoat layer includes the cured product having electron transportability and the particles including titanium oxide. The second undercoat layer is preferably formed immediately on the first undercoat layer because this allows a part of holes and a part of free electrons generated from the titanium oxide irradiated with ultraviolet radiation to migrate toward the support side, which results in a large effect of suppressing formation of black dots with a low content of the cured product having electron transportability.

The thickness of the undercoat layer is preferably 0.05 μm or more and 30 μm or less and is more preferably 1 μm or more and 25 μm or less. In the case where the undercoat layer has a laminated structure, the thickness of the first undercoat layer is preferably 1 μm or more and 10 μm or less, and the thickness of the second undercoat layer is preferably 0.3 μm or more and 3 μm or less.

A commonly used electrophotographic photosensitive member is a cylindrical electrophotographic photosensitive member including a photosensitive layer, which is constituted by a charge generation layer and a charge transportation layer, formed on a cylindrical support. However, a belt-like electrophotographic photosensitive member and a sheet-like electrophotographic photosensitive member may also be employed.

Support

A support having conductivity (conductive support) is preferably used. Examples of the support include supports composed of a metal or an alloy, such as aluminium, an aluminium alloy, or a stainless steel. In the case where a support composed of aluminium or an aluminium alloy is used, an ED tube and an EI tube may be used, which may optionally be subjected to cutting, electrochemical polishing, or wet or dry honing. A support prepared by depositing an aluminium thin-film or an aluminium-alloy thin-film on a metal support or a resin support may be used. A support prepared by depositing a thin film composed of a conductive material such as indium oxide or tin oxide on a metal support or a resin support may also be used. A support prepared by mixing conductive particles such as carbon black, tin oxide particles, titanium oxide particles, or silver particles with a resin may also be used. A support composed of a plastic including a conductive resin may also be used. The surface of the support may optionally be cut, roughened, or anodized.

Optionally, a conductive layer may be interposed between the support and the undercoat layer. The conductive layer may be formed by applying a conductive-layer coating liquid, which is prepared by dispersing conductive particles in a resin, onto a support and drying the resulting coating film. Examples of the conductive particles include carbon black, acetylene black, metal powders such as an aluminium powder, a nickel powder, an iron powder, a nichrome powder, a copper powder, a zinc powder, and a silver powder, and metal oxide powders such as a conductive tin oxide powder and an ITO powder.

Examples of a resin used for forming the conductive layer include a polyester resin, a polycarbonate resin, a polyvinyl butyral resin, an acrylic resin, a silicone resin, an epoxy resin, a melamine resin, a urethane resin, a phenol resin, and an alkyd resin.

Examples of a solvent used for preparing the conductive-layer coating liquid include an ether solvent, an alcohol solvent, a ketone solvent, and an aromatic hydrocarbon solvent. The thickness of the conductive layer is preferably 0.2 μm or more and 40 μm or less.

Undercoat Layer

The undercoat layer, which is described above, is formed on the support or the conductive layer.

Charge Generation Layer

In the case where the photosensitive layer has a laminated structure, a charge generation layer is formed on the undercoat layer. The charge generation layer includes a charge generating substance and a binder resin.

Examples of the charge generating substance include azo pigments, perylene pigments, quinone pigments, indigoid pigments, phthalocyanine pigments, and perinone pigments. Among these substances, azo pigments and phthalocyanine pigments are preferably used. Among phthalocyanine pigments, oxytitanium phthalocyanine, chloro-gallium phthalocyanine, and hydroxygallium phthalocyanine are preferably used.

Examples of the binder resin used for forming the charge generation layer include polymers and copolymers of a vinyl compound such as styrene, vinyl acetate, vinyl chloride, an acrylic ester, a methacrylic ester, vinylidene fluoride, and trifluoroethylene; a polyvinyl alcohol resin; a polyvinyl acetal resin; a polycarbonate resin; a polyester resin; a polysulfone resin; a polyphenylene oxide resin; a polyurethane resin; a cellulose resin; a phenol resin; a melamine resin; a silicone resin; and an epoxy resin. Among these resins, a polyester resin, a polycarbonate resin, and a polyvinyl acetal resin are preferably used, and a polyvinyl acetal resin is more preferably used.

The charge generation layer may be formed by applying a charge-generation-layer coating liquid, which is prepared by dispersing a charge generating substance and a binder resin in a solvent, onto the undercoat layer and drying the resulting coating film. The charge generation layer may be formed by vapor deposition of the charge generating substance.

The mass ratio of the charge generating substance to the binder resin (i.e., charge generating substance/binder resin) contained in the charge generation layer is preferably 10/1 to 1/10 and is more preferably 5/1 to 1/5.

The thickness of the charge generation layer is preferably 0.05 μm or more and 5 μm or less. Examples of the solvent used for preparing the charge-generation-layer coating liquid include an alcohol solvent, a sulfoxide solvent, a ketone solvent, an ether solvent, an ester solvent, and an aromatic hydrocarbon solvent.

Hole Transportation Layer

In the case where the photosensitive layer has a laminated structure, a hole transportation layer is formed on the charge generation layer. The hole transportation layer includes a hole transporting substance and a binder resin.

Examples of the hole transporting substance include a polycyclic aromatic compound, a heterocyclic compound, a hydrazone compound, a styryl compound, a benzidine compound, a triarylamine compound, and a triphenylamine compound. Examples of the hole transporting substance also include a polymer having a main chain or a side chain that is a group derived from these compounds. Among these compounds, a triarylamine compound, a benzidine compound, and a styryl compound are preferably used. The above-described hole transporting substance may be used alone or in combination of two or more.

Examples of the binder resin constituting the hole transportation layer include a styrene resin, an acrylic resin, a polycarbonate resin, and a polyester resin. Among these resins, a polycarbonate resin and a polyester resin are preferably used. A polycarbonate resin and a polyester resin may be used alone, in combination of two, or in the form of a copolymer. In the case where a polycarbonate resin and a polyester resin are used in the form of a copolymer, the type of copolymerization may be any one of block copolymerization, random copolymerization, and alternating copolymerization.

The mass ratio of the hole transporting substance to the binder resin (hole transporting substance/binder resin) contained in the hole transportation layer is preferably 10/5 to 5/10 and is more preferably 10/8 to 6/10.

The thickness of the hole transportation layer is preferably 5 μm or more and 40 μm or less.

Surface Layer

A surface layer is formed on the hole transportation layer. The surface layer includes a cured product of a composition including a hole transporting substance having a polymerizable functional group and a photopolymerization initiator. The composition preferably further includes a radical-polymerizable monomer which does not have hole transportability (hole transporting structure). In order to increase crosslinking density and thereby enhance wear resistance, a cured product of a composition including a hole transporting substance having one polymerizable functional group, a radical-polymerizable monomer having three or more polymerizable functional groups, and a photopolymerization initiator is preferably used.

A method for forming the surface layer is described below. A coating liquid (surface-layer coating liquid) including the above-described composition is applied onto the hole transportation layer. Subsequently, since the composition includes the photopolymerization initiator, the resulting coating film is irradiated with ultraviolet radiation and thereby the composition is cured to form a cured product. Thus, the surface layer is formed.

Examples of the solvent used for preparing the surface-layer coating liquid include alcohol solvents such as methanol, ethanol, propanol, and butanol; ketone solvents such as acetone, methyl ethyl ketone, methyl isobutyl ketone, and cyclohexanone; ester solvents such as ethyl acetate and butyl acetate; ether solvents such as tetrahydrofuran, dioxane, and propyl ether; halogenated solvents such as dichloromethane, dichloroethane, trichloroethane, and chlorobenzene; aromatic hydrocarbon solvents such as benzene, toluene, and xylene; and cellosolve solvents such as methyl cellosolve, ethyl cellosolve, and cellosolve acetate. The above-described solvents may be used alone or in combination of two or more. Preferably, tetrahydrofuran is used.

The surface-layer coating liquid may be applied onto the hole transportation layer by dip coating, spray coating, bead coating, or ring coating. Among these methods, spray coating is preferably employed from the viewpoint of adhesiveness between the surface layer and the hole transportation layer disposed below the surface layer.

Ultraviolet irradiation may be performed using a UV light source such as a high-pressure mercury-vapor lamp or a metal halide lamp. The amount of irradiation is preferably 50 mW/cm$^2$ or more and 1,000 mW/cm$^2$ or less in order to control a curing reaction to be appropriately conducted.

The above-described hole transporting substance having a polymerizable functional group is preferably a compound having a hole transporting structure and a polymerizable functional group, such as triarylamine, hydrazone, pyrazoline, or carbazole. In particular, the polymerizable functional group is preferably an acryloyloxy group or a methacryloyloxy group.

The hole transporting substance having three or more acryloyloxy groups may be prepared by, for example, esterification or transesterification of a hole transporting substance having three or more hydroxy groups in its molecule with an acrylic acid (salt), an acrylic halide, or an acrylic ester. The hole transporting substance having three or more methacryloyloxy groups may be prepared in the same manner.

The hole transporting substance having a polymerizable functional group is preferably the compound represented by Structural Formula (F) below.

(F)

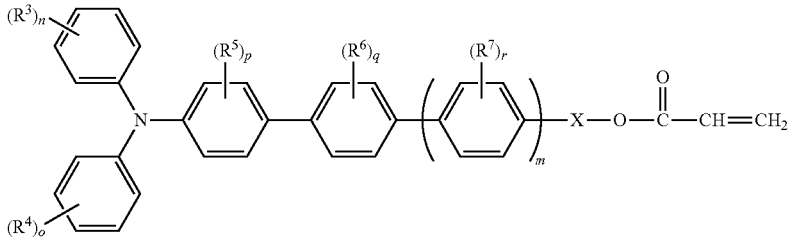

In Structural Formula (F), $R^3$, $R^4$, $R^5$, $R^6$, and $R^7$ each independently represent an alkyl group having 1 to 4 carbon atoms; and $R^5$ and $R^6$ may form a ring together. Examples of the alkyl group having 1 to 4 carbon atoms include a methyl group, an ethyl group, an n-propyl group, an isopropyl group, and a t-butyl group. An example of the ring structure formed by $R^5$ and $R^6$ is a fluorene ring. In Structural Formula (F), n and o each represent an integer of 0 to 5; and p, q, and r each represent an integer of 0 to 4. When n, o, p, q, or r is 2 or more, the numbers of carbon atoms of the two or more alkyl groups may be different. In Structural Formula (F), m is 0 or 1; and X represents a single bond, an alkylene group, an alkyleneoxy group, or divalent group represented by —$(R^8O)_s$—. Examples of the alkylene group include a linear or branched alkylene group having 1 to 6 carbon atoms, such as a methylene group, a 1,2-ethylene group, a 1,3-propylene group, a 1,2-propylene group, a 2,2-propylene group, a 1,4-butylene group, or 1,5-pentylene group. Examples of the alkyleneoxy group include an ethyleneoxy group, a propyleneoxy group, and a ring-opened caprolactone group. $R^8$ represents an alkylene group having 1 to 4 carbon atoms, and s is an integer of 2 to 4.

Specific examples of the hole transporting substance having a polymerizable functional group include, but are not limited to, the following.

(F1)
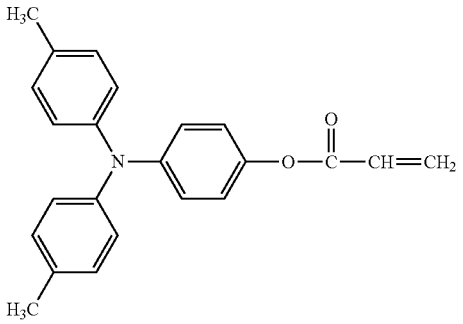
(F2)
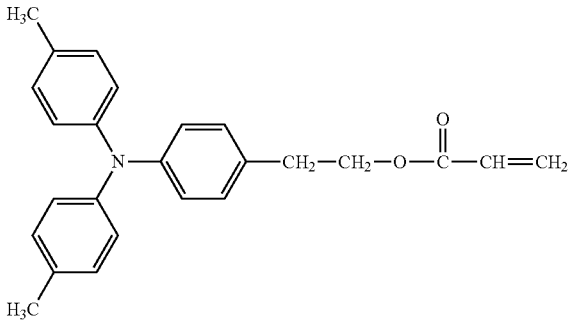
(F3)
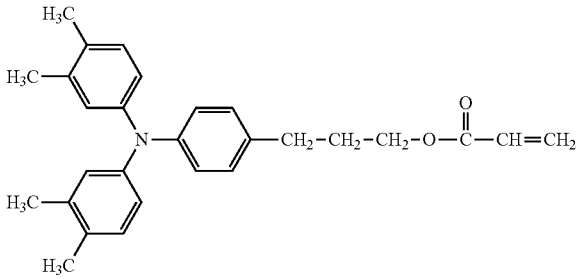
(F4)
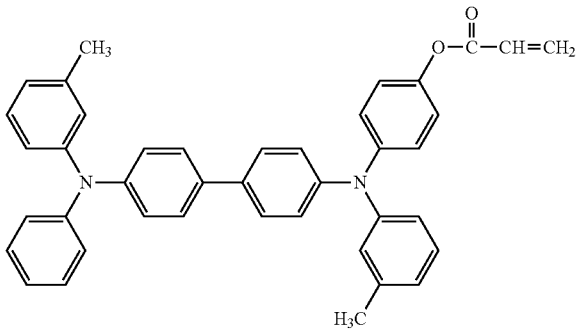
(F5)
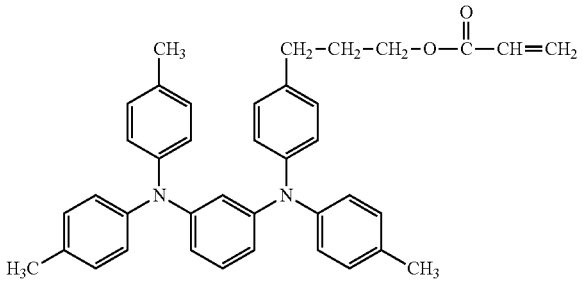
(F6)
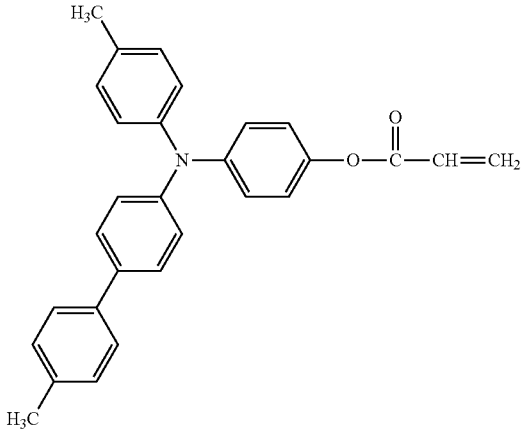
(F7)
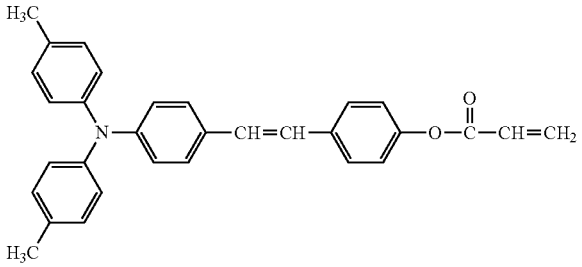
(F8)
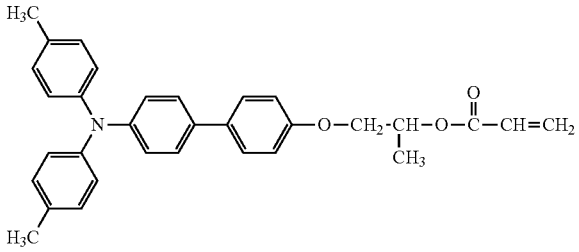

-continued
(F9)
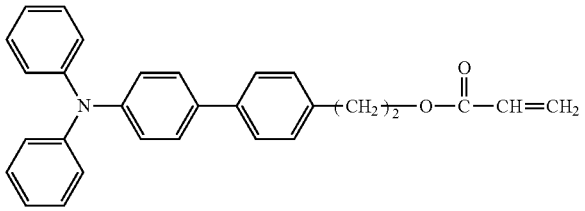
(F10)
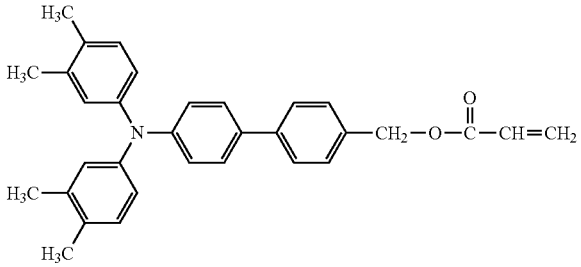
(F11)
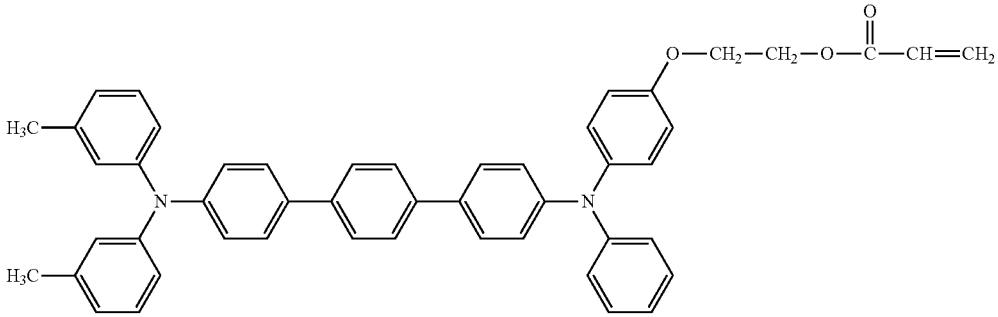
(F12)
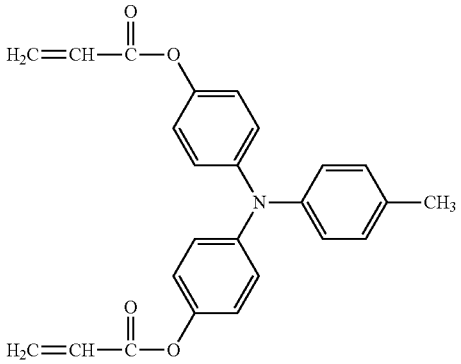
(F13)
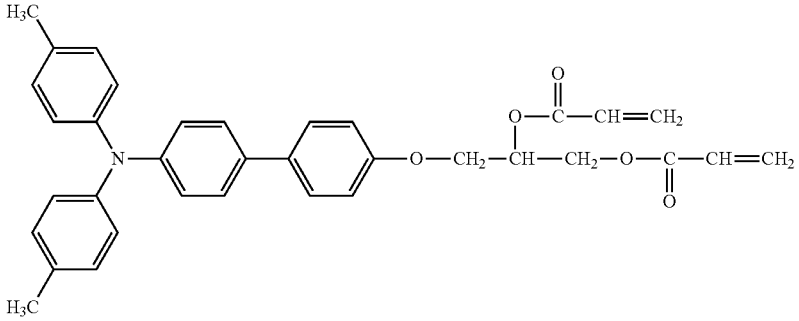

-continued (F14)

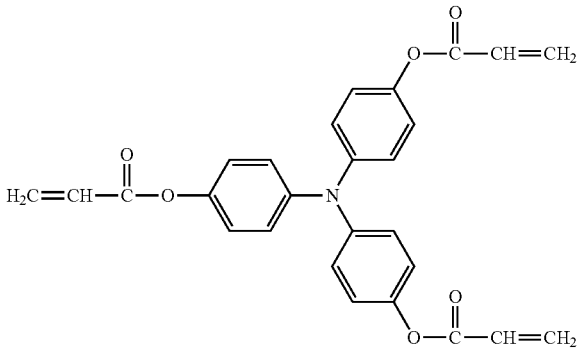

Examples of the radical-polymerizable monomer which does not have hole transportability include trimethylolpropane triacrylate (TMPTA), trimethylolpropane trimethacrylate, trimethylolpropane alkylene-modified triacrylate, trimethylolpropane ethylene-oxide-modified (hereinafter, referred to as "EO-modified") triacrylate, trimethylolpropane propylene-oxide-modified (hereinafter, referred to as "PO-modified") triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified (hereinafter, referred to as "ECH-modified") triacrylate, glycerol EO-modified triacrylate, glycerol PO-modified triacrylate, tris(acryloxyethyl) isocyanurate, dipentaerythritol hexaacrylate (DPHA), dipentaerythritol caprolactone-modified hexaacrylate, dipentaerythritol hydroxy pentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerythritol ethoxy tetraacrylate, phosphoric acid EO-modified triacrylate, and 2,2,5,5-tetrahydroxymethylcyclopentanone tetraacrylate. These radical-polymerizable monomers may be used alone or in combination of two or more.

If the proportion of the radical-polymerizable monomer which does not have hole transportability is small, wear resistance may fail to be sufficiently enhanced. A large proportion of the radical-polymerizable monomer which does not have hole transportability may reduce the content of the hole transporting substance. Thus, the content of the radical-polymerizable monomer which has three or more functional groups and which does not have hole transportability is preferably 20% by mass or more and 80% by mass or less and is more preferably 30% by mass or more and 70% by mass or less of the whole mass of the surface layer.

In the case where the surface layer is formed using ultraviolet radiation, a photopolymerization initiator (ultraviolet polymerization initiator) may be added to the surface-layer coating liquid. The photopolymerization initiator is not particularly limited as long as it facilitates generation of radicals by being irradiated with light (ultraviolet radiation). Examples of such a photopolymerization initiator include acetophenone or ketal photopolymerization initiators such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropan-1-one, 2-methyl-2-morpholino(4-methylthiophenyl)propan-1-one, and 1-phenyl-1,2-propandione-2-(o-ethoxycarbonyl)oxime; benzoin ether-based photopolymerization initiators such as benzoin, benzoin methyl ether, benzoin ethyl ether, benzoin isobutyl ether, and benzoin isopropyl ether; benzophenone-based photopolymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, and 1,4-benzoylbenzene; and thioxanthone-based photopolymerization initiators such as 2-isopropylthioxanthone, 2-chlorothioxanthone, 2,4-dimethylthioxanthone, 2,4-diethylthioxanthone, and 2,4-dichlorothioxanthone. Other examples of such a photopolymerization initiator include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenyl glyoxy ester, 9,10-phenanthrene, acridine-based compounds, triazine-based compounds, and imidazole-based compounds. The above-described photopolymerization initiators may be used alone or in combination of two or more. The content of the photopolymerization initiator is preferably 0.5 parts by mass or more and 40 parts by mass or less and is more preferably 1 part by mass or more and 20 parts by mass or less relative to 100 parts by mass of a compound having a polymerizable functional group (the hole transporting substance having a polymerizable functional group and the radical-polymerizable monomer which does not have hole transportability).

The thickness of the surface layer is preferably 1 μm or more and 10 μm or less and is more preferably 2 μm or more and 8 μm or less.

An antidegradant such as an antioxidant, an ultraviolet absorber, or a light stabilizer and fine particles such as organic fine particles or inorganic fine particles may be added to the above-described layers constituting the electrophotographic photosensitive member. Examples of the antioxidant include a hindered phenol antioxidant, a hindered amine light stabilizer, a sulfur atom-containing antioxidant, and a phosphorus atom-containing antioxidant. Examples of the organic fine particles include polymer particles such as fluorine atom-containing resin particles, polystyrene fine particles, and polyethylene particles. Examples of the inorganic fine particles include particles of a metal oxide such as silica or alumina.

The above-described coating liquids for forming each layer constituting the electrophotographic photosensitive member may be applied by a method such as dip coating, spray coating, spinner coating, roller coating, Meyer rod coating, or blade coating.

FIG. 1 schematically shows an example of the structure of an electrophotographic apparatus including a process cartridge including the electrophotographic photosensitive member according to the embodiment.

The electrophotographic apparatus shown in FIG. 1 includes a cylindrical electrophotographic photosensitive member 1, which is rotated about a shaft 2 in the direction of the arrow at a predetermined circumferential velocity. The surface of the electrophotographic photosensitive member 1, which is rotated, is uniformly charged to a predetermined positive or negative potential using a charging unit 3 (primary charging unit: charging roller, etc.). Subsequently, the charged surface is irradiated with exposure light 4 (image exposure light) emitted from an exposure unit (not shown) such as slit exposure or laser beam scanning exposure. In this manner, an electrostatic latent image associated with a desired image is sequentially formed on the surface of the electrophotographic photosensitive member 1.

The electrostatic latent image, which is formed on the surface of the electrophotographic photosensitive member 1, is developed using a toner contained in a developing agent housed in a developing unit 5 to form a toner image. The toner image, which is formed and supported on the surface of the electrophotographic photosensitive member 1, is then sequentially transferred onto a transfer material P (e.g., paper) due to a transfer bias applied using a transfer unit 6 (e.g., transfer roller). The transfer material P is picked up from a transfer material supply unit (not shown) in synchronization with rotation of the electrophotographic photosensitive member 1 and fed to a contact portion at which the electrophotographic photosensitive member 1 is in contact with the transfer unit 6.

The transfer material P, on which a toner image is transferred, is separated from the surface of the electrophotographic photosensitive member 1, introduced into a fixing unit 8 in order to fix the toner image onto the transfer material P, and then printed out outside of the apparatus as an image-recorded item (e.g., print or copy).

After transfer of the toner image, the surface of the electrophotographic photosensitive member 1 is cleaned by removing a portion of the developing agent which has not been transferred onto the transfer material P (hereinafter, referred to as "untransferred toner") using a cleaning unit (e.g., cleaning blade). Static charge of the electrophotographic photosensitive member 1 is removed by irradiating the electrophotographic photosensitive member 1 with pre-exposure light (not shown) emitted from a pre-exposure unit (not shown), and the electrophotographic photosensitive member 1 is used for image formation repeatedly. The pre-exposure is not necessarily performed in the case where the charging unit 3 is a contact charging unit such as a charging roller as shown in FIG. 1.

A plurality of components are selected from the electrophotographic photosensitive member 1, the charging unit 3, the developing unit 5, the transfer unit 6, the cleaning unit 7, and the like to integrally form a process cartridge. The process cartridge may be detachably attachable to the main body of an electrophotographic apparatus such as a copying machine or a laser beam printer. In FIG. 1, the electrophotographic photosensitive member 1, the charging unit 3, the developing unit 5, and the cleaning unit 7 are integrally supported to form a cartridge, and a guiding unit 10 serving as rails disposed on the main body of the electrophotographic apparatus is provided. Thus, the process cartridge 9 detachably attachable to the main body of the electrophotographic apparatus is formed.

EXAMPLES

Embodiments of the present invention are described further in detail with reference to Examples and Comparative Examples below, which do not limit the present invention. Note that the term "part" used in Examples and Comparative Examples refers to "part by mass".

Example 1

A mirror-polished aluminium cylinder (conductive support) having a length of 260.5 mm and a diameter of 30 mm was prepared.

In a solvent that was 100 parts of methyl ethyl ketone, 35 parts of an alkyd resin (BECKOLITE M-6401-50-S, solid content: 50%, produced by DIC Corporation), 15 parts of a melamine resin (Super Beckamine G-821-60, solid content: 60%, produced by DIC Corporation), and 50 parts of titanium oxide (CR-EL, produced by ISHIHARA SANGYO KAISHA, LTD.) were mixed to prepare a first-undercoat-layer coating liquid. The first-undercoat-layer coating liquid was applied onto the conductive support by dip coating to form a coating film. The coating film was dried (cured by heat) at 160° C. for 30 minutes. Thus, a first undercoat layer having a thickness of 1.5 μm was formed. The first undercoat layer included an alkyd melamine resin and titanium oxide particles.

In a mixed solvent of 50 parts of methanol and 50 parts of dimethylacetamide, 9 parts of Compound A401 (electron transporting substance) and 6 parts of Exemplary Compound B5 (crosslinking agent) were dissolved to prepare a second-undercoat-layer coating liquid. The second-undercoat-layer coating liquid was applied onto the first undercoat layer by dip coating to form a coating film. The coating film was dried (cured by heat) at 160° C. for 30 minutes to form a second undercoat layer having a thickness of 0.5 μm. Thus, a second undercoat layer including a cured product having electron transportability was formed.

Subsequently, 10 parts of a hydroxygallium phthalocyanine crystal (in CuKα characteristic X-ray diffraction, diffraction peaks occur at Bragg angles (2θ±0.2°) of 7.5°, 9.9°, 16.3°, 18.6°, 25.1°, and 28.3°), which served as a charge generating substance, was prepared. In the charge generating substance, 250 parts of cyclohexanone and 5 parts of a polyvinyl butyral resin (S-LEC BX-1, produced by SEKISUI CHEMICAL CO., LTD) were mixed. The resulting mixture was stirred at 23±3° C. for 1 hour using a sand mill with glass beads having a diameter of 1 mm to form a dispersion liquid. Subsequently, 250 parts of ethyl acetate was added to the dispersion liquid. Thus, a charge-generation-layer coating liquid was prepared. The charge-generation-layer coating liquid was applied onto the second undercoat layer by dip coating to form a coating film. The coating film was dried at 100° C. for 10 minutes. Thus, a charge generation layer having a thickness of 0.26 μm was formed.

In 50 parts of monochlorobenzene, 5 parts of the compound represented by Structural Formula (CTM-1) below, 5 parts of the compound represented by Structural Formula (CTM-2) below, and 10 parts of a polycarbonate resin having the structural unit represented by Structural Formula (B1-1) were dissolved to prepare a hole-transportation-layer coating liquid. The hole-transportation-layer coating liquid was applied onto the charge generation layer by dip coating to form a coating film. The coating film was dried at 120° C.

for 30 minutes. Thus, a hole transportation layer having a thickness of 20 μm was formed.

(CTM-1)

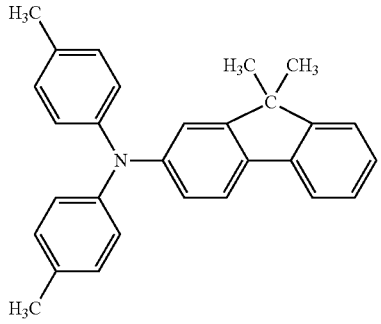

(CTM-2)

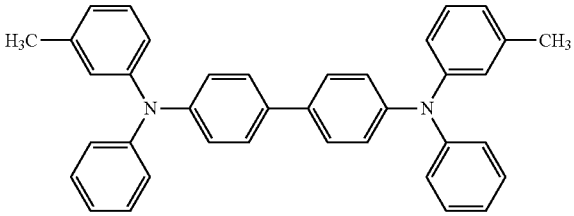

(B1-1)

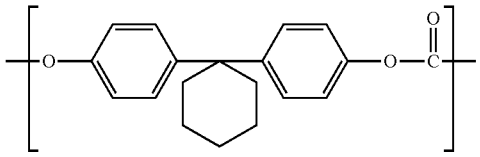

In 100 parts of 2-propanol, 10 parts of the compound represented by Structural Formula (F1) above, 10 parts of trimethylolpropane triacrylate, and 1 part of a photopolymerization initiator (1-hydroxy-cyclohexyl-phenyl-ketone, IRGACURE 184, produced by Ciba Specialty Chemicals Inc.) were dissolved to prepare a surface-layer coating liquid. The surface-layer coating liquid was applied onto the hole transportation layer by spray coating. The resulting coating film was air-dried for 20 minutes. Subsequently, while the conductive support was rotated and cooled from inside using water, the dried coating film was irradiated with a metal halide lamp (160 W/cm) from a distance of 120 mm at an intensity of 500 mW/cm$^2$ for 180 seconds. The resulting coating film was dried at 130° C. for 30 minutes. Thus, a surface layer having a thickness of 5 μm was formed. During ultraviolet irradiation, the inside of the ultraviolet irradiation apparatus was replaced by nitrogen gas so that the oxygen density in the apparatus was maintained at 1% by mass or less. Thus, a surface layer including a cured product formed by irradiating, with ultraviolet radiation, a composition including a hole transporting substance having a polymerizable functional group and a photopolymerization initiator was prepared.

In the above-described manner, an electrophotographic photosensitive member including a support, a first undercoat layer, a second undercoat layer, a charge generation layer, a hole transportation layer, and a surface layer, which were stacked in order, was prepared.

Example 2

An electrophotographic photosensitive member was prepared as in Example 1 except that, when a hole transportation layer was formed, the hole transporting substance included in the hole transportation layer in Example 1 was changed to 10 parts of the compound represented by Structural Formula (CTM-1).

Example 3

An electrophotographic photosensitive member was prepared as in Example 1 except that, when a hole transportation layer was formed, the hole transporting substance included in the hole transportation layer in Example 1 was changed to 10 parts of the compound represented by Structural Formula (CTM-2).

Example 4

An electrophotographic photosensitive member was prepared as in Example 1 except that, when a hole transportation layer was formed, the hole transporting substance included in the hole transportation layer in Example 1 was changed to 10 parts of the compound represented by Structural Formula (CTM-3) below.

(CTM-3)

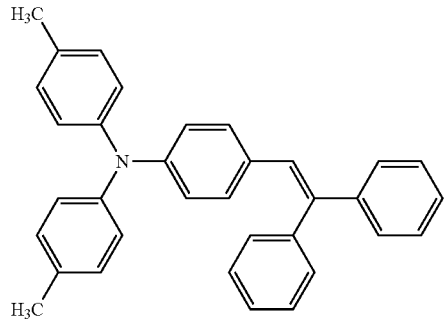

Examples 5 to 17

An electrophotographic photosensitive member was prepared as in Example 1 except that a second undercoat layer and a surface layer were formed as follows.

The second undercoat layer was formed as in Example 1 except that the type of crosslinking agent was changed as shown in Table 12.

The surface layer was formed as in Example 1 except that the types and the contents of hole transporting substance having a polymerizable functional group, radical-polymerizable monomer which does not have hole transportability, and photopolymerization initiator were changed as shown in Table 14.

TABLE 12

| Example | Second undercoat layer: Electron transporting substance Type | Electron transporting substance Parts | Cross-linking agent Type | Cross-linking agent Parts | Resin D Type | Resin D Parts | Thickness (μm) | First undercoat layer: Alkyd-melamine resin (parts) | Titanium oxide particles | Thickness (μm) | Content A | Content B | Band gap (eV) |
|---|---|---|---|---|---|---|---|---|---|---|---|---|---|
| 1 | A401 | 9 | B5 | 6 | — | 0 | 0.5 | 50 | CR-EL | 1.5 | 57 | 23 | 2.0 |
| 2 | A401 | 9 | B5 | 6 | — | 0 | 0.5 | 50 | CR-EL | 1.5 | 57 | 23 | 2.0 |
| 3 | A401 | 9 | B5 | 6 | — | 0 | 0.5 | 50 | CR-EL | 1.5 | 57 | 23 | 2.0 |
| 4 | A401 | 9 | B5 | 6 | — | 0 | 0.5 | 50 | CR-EL | 1.5 | 57 | 23 | 2.0 |
| 5 | A401 | 9 | B5 | 6 | — | 0 | 0.5 | 50 | CR-EL | 1.5 | 57 | 23 | 2.0 |
| 6 | A401 | 9 | B5 | 6 | — | 0 | 0.5 | 50 | CR-EL | 1.5 | 57 | 23 | 2.0 |
| 7 | A401 | 9 | B5 | 6 | — | 0 | 0.5 | 50 | CR-EL | 1.5 | 57 | 23 | 2.0 |
| 8 | A401 | 9 | B5 | 6 | — | 0 | 0.5 | 50 | CR-EL | 1.5 | 57 | 23 | 2.0 |
| 9 | A401 | 9 | B5 | 6 | — | 0 | 0.5 | 50 | CR-EL | 1.5 | 57 | 23 | 2.0 |
| 10 | A401 | 9 | B5 | 6 | — | 0 | 0.5 | 50 | CR-EL | 1.5 | 57 | 23 | 2.0 |
| 11 | A401 | 9 | B2 | 6 | — | 0 | 0.5 | 50 | CR-EL | 1.5 | 57 | 23 | 2.0 |
| 12 | A401 | 9 | B5 | 6 | — | 0 | 0.5 | 50 | CR-EL | 1.5 | 57 | 23 | 2.0 |
| 13 | A401 | 9 | B5 | 6 | — | 0 | 0.5 | 50 | CR-EL | 1.5 | 57 | 23 | 2.0 |
| 14 | A401 | 9 | B5 | 6 | — | 0 | 0.5 | 50 | CR-EL | 1.5 | 57 | 23 | 2.0 |
| 15 | A401 | 9 | B9 | 6 | — | 0 | 0.5 | 50 | CR-EL | 1.5 | 57 | 23 | 2.0 |
| 16 | A401 | 9 | B5 | 6 | — | 0 | 0.5 | 50 | CR-EL | 1.5 | 57 | 23 | 2.0 |
| 17 | A401 | 9 | B5 | 6 | — | 0 | 0.5 | 50 | CR-EL | 1.5 | 57 | 23 | 2.0 |
| 18 | A401 | 9 | B5 | 6 | — | 0 | 0.5 | 50 | JR-605 | 1.5 | 57 | 23 | 2.0 |
| 19 | A401 | 9 | B5 | 6 | — | 0 | 0.5 | 50 | JR-800 | 1.5 | 57 | 23 | 2.0 |
| 20 | A401 | 9 | B5 | 6 | — | 0 | 0.5 | 50 | JR-1000 | 1.5 | 57 | 23 | 2.0 |
| 21 | A401 | 9 | B5 | 6 | — | 0 | 0.5 | 50 | CR-85 | 1.5 | 57 | 23 | 2.0 |
| 22 | A401 | 9 | B5 | 6 | — | 0 | 0.5 | 50 | PF-711 | 1.5 | 57 | 23 | 2.0 |
| 23 | A401 | 9 | B5 | 6 | — | 0 | 0.5 | 50 | R-5N | 1.5 | 57 | 23 | 2.0 |
| 24 | A401 | 9 | B5 | 6 | — | 0 | 0.5 | 50 | R-62N | 1.5 | 57 | 23 | 2.0 |
| 25 | A401 | 9 | B5 | 6 | — | 0 | 0.5 | 50 | FPT-1 | 1.5 | 57 | 23 | 2.0 |
| 26 | A401 | 9 | B5 | 6 | — | 0 | 0.5 | 50 | A-197 | 1.5 | 57 | 23 | 2.0 |
| 27 | A401 | 9 | B10 | 6 | — | 0 | 0.5 | 50 | CR-EL | 1 | 57 | 23 | 2.0 |
| 28 | A401 | 9 | B5 | 6 | — | 0 | 0.5 | 50 | CR-EL | 10 | 57 | 23 | 2.0 |
| 29 | A401 | 9 | B5 | 6 | — | 0 | 0.3 | 50 | CR-EL | 1.5 | 57 | 23 | 2.0 |
| 30 | A401 | 9 | B5 | 6 | — | 0 | 3 | 50 | CR-EL | 1.5 | 57 | 23 | 2.0 |
| 31 | A401 | 9 | B5 | 6 | — | 0 | 3 | 90 | CR-EL | 1.5 | 22 | 60 | 2.0 |
| 32 | A401 | 9 | B5 | 6 | — | 0 | 3 | 80 | CR-EL | 1.5 | 30 | 43 | 2.0 |
| 33 | A401 | 9 | B5 | 6 | — | 0 | 3 | 60 | CR-EL | 1.5 | 43 | 33 | 2.0 |
| 34 | A401 | 9 | B5 | 6 | — | 0 | 3 | 60 | CR-EL | 1.5 | 48 | 27 | 2.0 |
| 35 | A401 | 9 | B5 | 6 | — | 0 | 3 | 40 | CR-EL | 1.5 | 65 | 20 | 2.0 |
| 36 | A401 | 9 | C1-1 | 6 | — | 0 | 3 | 30 | CR-EL | 1.5 | 74 | 18 | 2.0 |
| 37 | A401 | 9 | B5 | 6 | — | 0 | 3 | 20 | CR-EL | 1.5 | 83 | 16 | 2.0 |
| 38 | A401 | 9 | B5 | 6 | — | 0 | 3 | 10 | CR-EL | 1.5 | 91 | 14 | 2.0 |
| 39 | A401 | 6.4 | B5 | 4 | D5 | 4 | 0.5 | 50 | CR-EL | 1 | 56 | 22 | 2.0 |
| 40 | A401 | 6.4 | B5 | 4 | D5 | 4 | 0.5 | 50 | CR-EL | 10 | 56 | 22 | 2.0 |
| 41 | A401 | 6.4 | B5 | 4 | D5 | 4 | 0.3 | 50 | CR-EL | 1.5 | 56 | 22 | 2.0 |
| 42 | A401 | 6.4 | B5 | 4 | D5 | 4 | 3 | 50 | CR-EL | 1.5 | 56 | 22 | 2.0 |
| 43 | A401 | 6.4 | B5 | 4 | D12 | 4 | 3 | 90 | CR-EL | 1.5 | 21 | 59 | 2.0 |

TABLE 13

| Example | Second undercoat layer: Electron transporting substance Type | Electron transporting substance Parts | Cross-linking agent Type | Cross-linking agent Parts | Resin D Type | Resin D Parts | Thickness (μm) | First undercoat layer: Alkyd-melamine resin (parts) | Titanium oxide particles | Thickness (μm) | Content A | Content B | Band gap (eV) |
|---|---|---|---|---|---|---|---|---|---|---|---|---|---|
| 44 | A401 | 6.4 | B5 | 4 | D12 | 4 | 3 | 80 | CR-EL | 1.5 | 30 | 42 | 2.0 |
| 45 | A401 | 6.4 | C1-5 | 4 | D12 | 4 | 3 | 60 | CR-EL | 1.5 | 43 | 32 | 2.0 |
| 46 | A401 | 6.4 | B5 | 4 | D12 | 4 | 3 | 60 | CR-EL | 1.5 | 48 | 26 | 2.0 |
| 47 | A401 | 6.4 | B5 | 4 | D21 | 4 | 3 | 40 | CR-EL | 1.5 | 65 | 19 | 2.0 |
| 48 | A401 | 6.4 | B5 | 4 | D21 | 4 | 3 | 30 | CR-EL | 1.5 | 74 | 17 | 2.0 |
| 49 | A401 | 6.4 | B5 | 4 | D21 | 4 | 3 | 20 | CR-EL | 1.5 | 83 | 15 | 2.0 |
| 50 | A401 | 6.4 | B5 | 4 | D21 | 4 | 3 | 10 | CR-EL | 1.5 | 91 | 14 | 2.0 |
| 51 | A101 | 9 | B5 | 6 | — | 0 | 0.5 | 50 | CR-EL | 1.5 | 57 | 23 | 0.4 |
| 52 | A107 | 9 | C1-8 | 6 | — | 0 | 0.5 | 50 | CR-EL | 1.5 | 57 | 23 | 0.5 |
| 53 | A108 | 9 | B5 | 6 | — | 0 | 0.5 | 50 | CR-EL | 1.5 | 57 | 23 | 0.3 |
| 54 | A110 | 9 | B5 | 6 | — | 0 | 0.5 | 50 | CR-EL | 1.5 | 57 | 23 | 0.5 |
| 55 | A112 | 9 | B5 | 6 | — | 0 | 0.5 | 50 | CR-EL | 1.5 | 57 | 23 | 0.3 |
| 56 | A205 | 9 | B5 | 6 | — | 0 | 0.5 | 50 | CR-EL | 1.5 | 57 | 23 | 2.2 |
| 57 | A211 | 9 | B5 | 6 | — | 0 | 0.5 | 50 | CR-EL | 1.5 | 57 | 23 | 1.7 |

TABLE 13-continued

| Example | Second undercoat layer: Electron transporting substance Type | Parts | Cross-linking agent Type | Parts | Resin D Type | Parts | Thickness (μm) | First undercoat layer: Alkyd-melamine resin (parts) | Titanium oxide particles | Thickness (μm) | Content A | Content B | Band gap (eV) |
|---|---|---|---|---|---|---|---|---|---|---|---|---|---|
| 58 | A301 | 9 | B5 | 6 | — | 0 | 0.5 | 50 | CR-EL | 1.5 | 57 | 23 | 1.9 |
| 59 | A304 | 9 | B5 | 6 | — | 0 | 0.5 | 50 | CR-EL | 1.5 | 57 | 23 | 1.5 |
| 60 | A310 | 9 | B5 | 6 | — | 0 | 0.5 | 50 | CR-EL | 1.5 | 57 | 23 | 2.1 |
| 61 | A403 | 9 | B5 | 6 | — | 0 | 0.5 | 50 | CR-EL | 1.5 | 57 | 23 | 2.0 |
| 62 | A405 | 9 | B5 | 6 | — | 0 | 0.5 | 50 | CR-EL | 1.5 | 57 | 23 | 2.0 |
| 63 | A406 | 9 | B5 | 6 | — | 0 | 0.5 | 50 | CR-EL | 1.5 | 57 | 23 | 2.0 |
| 64 | A408 | 9 | C1-9 | 6 | — | 0 | 0.5 | 50 | CR-EL | 1.5 | 57 | 23 | 1.8 |
| 65 | A410 | 9 | B5 | 6 | — | 0 | 0.5 | 50 | CR-EL | 1.5 | 57 | 23 | 2.0 |
| 66 | A411 | 9 | B5 | 6 | — | 0 | 0.5 | 50 | CR-EL | 1.5 | 57 | 23 | 1.9 |
| 67 | A502 | 9 | B5 | 6 | — | 0 | 0.5 | 50 | CR-EL | 1.5 | 57 | 23 | 1.6 |
| 68 | A506 | 9 | B5 | 6 | — | 0 | 0.5 | 50 | CR-EL | 1.5 | 57 | 23 | 2.0 |
| 69 | A511 | 9 | C1-10 | 6 | — | 0 | 0.5 | 50 | CR-EL | 1.5 | 57 | 23 | 1.7 |
| 70 | A604 | 9 | B5 | 6 | — | 0 | 0.5 | 50 | CR-EL | 1.5 | 57 | 23 | 1.4 |
| 71 | A609 | 9 | B5 | 6 | — | 0 | 0.5 | 50 | CR-EL | 1.5 | 57 | 23 | 1.7 |
| 72 | A612 | 9 | B5 | 6 | — | 0 | 0.5 | 50 | CR-EL | 1.5 | 57 | 23 | 2.7 |
| 73 | A701 | 9 | B5 | 6 | — | 0 | 0.5 | 50 | CR-EL | 1.5 | 57 | 23 | 1.9 |
| 74 | A703 | 9 | B5 | 6 | — | 0 | 0.5 | 50 | CR-EL | 1.5 | 57 | 23 | 2.0 |
| 75 | A708 | 9 | C1-11 | 6 | — | 0 | 0.5 | 50 | CR-EL | 1.5 | 57 | 23 | 2.2 |
| 76 | A711 | 9 | B5 | 6 | — | 0 | 0.5 | 50 | CR-EL | 1.5 | 57 | 23 | 2.4 |
| 77 | A802 | 9 | B5 | 6 | — | 0 | 0.5 | 50 | CR-EL | 1.5 | 57 | 23 | 2.1 |
| 78 | A808 | 9 | B5 | 6 | — | 0 | 0.5 | 50 | CR-EL | 1.5 | 57 | 23 | 1.8 |
| 79 | A810 | 9 | C1-12 | 6 | — | 0 | 0.5 | 50 | CR-EL | 1.5 | 57 | 23 | 2.1 |
| 80 | A902 | 9 | B5 | 6 | — | 0 | 0.5 | 50 | CR-EL | 1.5 | 57 | 23 | 1.2 |
| 81 | A905 | 9 | B5 | 6 | — | 0 | 0.5 | 50 | CR-EL | 1.5 | 57 | 23 | 1.2 |
| 82 | A1001 | 9 | B5 | 6 | — | 0 | 0.5 | 50 | CR-EL | 1.5 | 57 | 23 | 2.3 |
| 83 | A1005 | 9 | B5 | 6 | — | 0 | 0.5 | 50 | CR-EL | 1.5 | 57 | 23 | 2.3 |

Resin D5 used in Examples 39 to 42 shown in Table 12 has a characteristic ester structure represented by Structural Formula (E-3) above, where $R^{206}$ is p-phenylene and $R^{207}$ is $C_3H_6$. Resin D12 used in Examples 43 to 46 shown in Tables 12 and 13 has a characteristic ester structure represented by Structural Formula (E-3) above, where $R^{206}$ is p-phenylene and $R^{207}$ is $C_3H_6$. Resin D21 used in Examples 47 to 50 shown in Table 13 has a characteristic polyester structure represented by Structural Formula (E-3) above, where $R^{206}$ is p-phenylene and $R^{207}$ is $C_3H_6$.

In Tables 12 and 13, the item name "Content A" refers to the total content (mass %) of the particles including titanium oxide and the cured product having electron transportability relative to the whole mass of the undercoat layer (in the case where the undercoat layer has a laminated structure, relative to the total mass of the first and second undercoat layers). The item name "Content B" refers to the content (mass %) of the cured product having electron transportability relative to the total mass of the particles including titanium oxide and the cured product having electron transportability.

TABLE 14

| Example | Hole transporting substance Type | Parts | Radical-polymerizable monomer Type | Parts | Photopolymerization initiator |
|---|---|---|---|---|---|
| 1 | (F1) | 10 | Trimethylolpropane triacrylate | 10 | 1-Hydroxy-cyclohexyl-phenyl-ketone |
| 5 | (F2) | 10 | Trimethylolpropane triacrylate | 10 | 1-Hydroxy-cyclohexyl-phenyl-ketone |
| 6 | (F4) | 10 | Trimethylolpropane triacrylate | 10 | 1-Hydroxy-cyclohexyl-phenyl-ketone |
| 7 | (F5) | 10 | Trimethylolpropane triacrylate | 10 | 1-Hydroxy-cyclohexyl-phenyl-ketone |
| 8 | (F8) | 10 | Trimethylolpropane triacrylate | 10 | 1-Hydroxy-cyclohexyl-phenyl-ketone |
| 9 | (F9) | 10 | Trimethylolpropane triacrylate | 10 | 1-Hydroxy-cyclohexyl-phenyl-ketone |
| 10 | (F11) | 10 | Trimethylolpropane triacrylate | 10 | 1-Hydroxy-cyclohexyl-phenyl-ketone |
| 11 | (F14) | 10 | Trimethylolpropane triacrylate | 30 | 1-Hydroxy-cyclohexyl-phenyl-ketone |
| 12 | (F1) | 10 | Trimethylolpropane trimethacrylate | 30 | Diethoxyacetophenone |
| 13 | (F1) | 10 | Trimethylolpropane caprolactone-modified triacrylate | 30 | 2,2-Dimethoxy-1,2-diphenylethan-1-one |

TABLE 14-continued

| | Hole transporting substance | | Radical-polymerizable monomer | | Photopolymerization |
|---|---|---|---|---|---|
| Example | Type | Parts | Type | Parts | initiator |
| 14 | (F1) | 10 | Dipentaerythritol caprolactone-modified hexaacrylate | 30 | 4-(2-Hydroxyethoxy)phenyl-(2-hydroxy-2-propyl)ketone |
| 15 | (F1) | 10 | Alkylated dipentaerythritol pentaacrylate | 30 | 2-Hydroxy-2-methyl-1-phenylpropan-1-one |
| 16 | (F1) | 10 | Dimethylolpropane tetraacrylate | 30 | Benzoin isopropyl ether |
| 17 | (F1) | 10 | Trimethylolpropane alkylene-modified trimethacrylate | 30 | Acrylated benzophenone |
| 84 | (F1) | 10 | Trimethylolpropane triacrylate | 10 | 1-Hydroxy-cyclohexyl-phenyl-ketone |
| 85 | (F1) | 10 | Alkylated dipentaerythritol triacrylate | 10 | Ethylanthraquinone |
| 86 | (F1) | 10 | Alkylated dipentaerythritol triacrylate | 10 | Ethylanthraquinone |

In Table 14, the item name "Hole transporting substance" refers to the hole transporting substance having a polymerizable functional group; and the item name "Radical-polymerizable monomer" refers to the radical-polymerizable monomer which does not have hole transportability. In Examples 2 to 4 and Examples 18 to 83, the surface layer was formed as in Example 1.

Examples 18 to 38 and Examples 51 to 83

An electrophotographic photosensitive member was prepared as in Example 1 except that a first undercoat layer and a second undercoat layer were formed as follows.

The first undercoat layer and the second undercoat layer were formed as in Example 1 except that the types of electron transporting substance, crosslinking agent, and particles including titanium oxide, the content of alkyd melamine resin, and the thicknesses of the first undercoat layer and the second undercoat layer were changed as shown in Tables 12 and 13.

Examples 39 to 50

An electrophotographic photosensitive member was prepared as in Example 1 except that a first undercoat layer and a second undercoat layer were formed as follows.

The first undercoat layer was formed as in Example 1 except that the content of alkyd melamine resin and the thickness of the first undercoat layer were changed as shown in Tables 12 and 13. The second undercoat layer was formed as in Example 1 except that the types and the contents of electron transporting substance and crosslinking agent and the thickness of the second undercoat layer were changed as shown in Tables 12 and 13 and the cured product having electron transportability was formed by further adding Resin D shown in Table 12 or 13.

Example 84

An electrophotographic photosensitive member was prepared as in Example 1 except that the undercoat layer having a laminated structure, that is, the first undercoat layer and the second undercoat layer, formed in Example 1 was changed to a single undercoat layer as described below.

In a mixed solvent of 50 parts of methanol and 50 parts of dimethylacetamide, 50 parts of N-methoxymethyl nylon resin (FR-101, produced by Namariichi Co., Ltd.), 50 parts of titanium oxide particles (CR-EL, produced by ISHIHARA SANGYO KAISHA, LTD.), 9 parts of Compound A401 (electron transporting substance), and 6 parts of Exemplary Compound B5 (crosslinking agent) were mixed to prepare an undercoat-layer coating liquid. The undercoat-layer coating liquid was applied onto the conductive support used in Example 1 by dip coating to form a coating film. The coating film was dried (cured by heat) at 160° C. for 30 minutes to form an undercoat layer having a thickness of 2.0 μm. Thus, an undercoat layer including the cured product having electron transportability and the titanium oxide particles was formed.

Example 85

An electrophotographic photosensitive member was prepared as in Example 84 except that the undercoat layer and the surface layer were formed as follows.

The undercoat layer was formed as in Example 84 except that the particles including titanium oxide used in Example 84 were changed to titanium oxide particles (JR-605, produced by TAYCA CORPORATION).

The surface layer was formed as in Example 84 except that the types of radical-polymerizable monomer which does not have hole transportability and photopolymerization initiator were changed as shown in Table 14.

Example 86

An electrophotographic photosensitive member was prepared as in Example 85 except that the undercoat layer was formed as follows.

In a mixed solvent of 50 parts of methanol and 50 parts of dimethylacetamide, 50 parts of N-methoxymethyl nylon resin (FR-101), 50 parts of titanium oxide particles (CR-EL), 6.4 parts of Compound A401, 4 parts of Exemplary Compound B5 (crosslinking agent), and 4 parts of Resin D5 were mixed to prepare an undercoat-layer coating liquid. The undercoat-layer coating liquid was applied onto the conductive support used in Example 1 by dip coating to form a coating film. The coating film was dried (cured by heat) at 160° C. for 30 minutes. Thus, an undercoat layer having a thickness of 1.5 μm was formed.

Comparative Example 1

An electrophotographic photosensitive member was prepared as in Example 84 except that 60 parts of N-methoxymethyl nylon (FR-101) and 45 parts of titanium oxide particles (CR-EL) were mixed in a mixture solvent of 50 parts of methanol and 50 parts of dimethylacetamide to prepare an undercoat-layer coating liquid.

Comparative Example 2

An electrophotographic photosensitive member was prepared as in Example 84 except that 60 parts of N-methoxymethyl nylon (FR-101), 45 parts of titanium oxide particles (CR-EL), 9 parts of the compound represented by Structural Formula (G1) below, and 10 parts of zirconium monoacetylacetonate compound (Orgatics ZC540, produced by MATSUMOTO PHARM. IND. CO., LTD.) were mixed in a mixture solvent of 50 parts of methanol and 50 parts of dimethylacetamide to prepare an undercoat-layer coating liquid.

(G1)

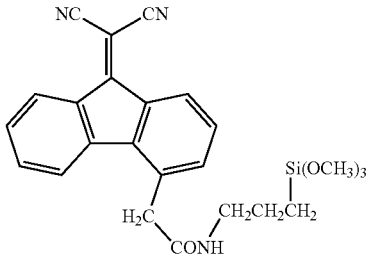

Comparative Example 3

An electrophotographic photosensitive member was prepared as in Example 84 except that an undercoat-layer coating liquid was prepared as follows.

In a mixture solvent of 50 parts of methanol and 50 parts of dimethylacetamide, 60 parts of N-methoxymethyl nylon (FR-101), 45 parts of titanium oxide particles (CR-EL), 9 parts of anthraquinone, and 10 parts of zirconium monoacetylacetonate compound (Orgatics ZC540, produced by MATSUMOTO PHARM. IND. CO., LTD.) were mixed to prepare the undercoat-layer coating liquid.

Evaluations of Black Dots and Potential Change

The electrophotographic photosensitive members prepared in Examples 1 to 86 and Comparative Examples 1 to 3 were evaluated by the following methods.

The electrophotographic apparatus used for evaluation was a laser beam printer LBP-2510 produced by CANON KABUSHIKI KAISHA. Modifications were made to the electrophotographic apparatus so that the charging conditions and the laser exposure dose could be controlled. Each electrophotographic photosensitive member was installed in a cyan process cartridge. The cyan process cartridge was attached to the cyan process cartridge station.

The charging conditions and the laser exposure dose were set so that the initial dark-portion potential and the light-portion potential of the surface of the electrophotographic photosensitive member were −500 V and −150 V, respectively at 25° C. and at a relative humidity of 15%. The surface potential of the electrophotographic photosensitive member was measured using a modified cartridge. Specifically, a potential probe (Model 6000B-8, produced by TREK Japan KK) was attached to the development position. The potential at the center of the electrophotographic photosensitive member was measured using a surface electrometer (Model 344, produced by TREK Japan KK).

Evaluation of black dots was conducted using an A4-size gloss paper. A solid white image was recorded on the paper, and the recorded image was visually evaluated in accordance with the following criteria. Table 15 shows the evaluation results.

Rank A: Black dots were not found.

Rank B: Black dots having a diameter of more than 0.3 mm and 0.6 mm or less were found.

Rank C: Black dots having a diameter of more than 0.6 mm and 0.9 mm or less were found.

Rank D: Black dots having a diameter of more than 0.9 mm were found.

In order to evaluate the potential change, 20,000 images were repeatedly recorded in one color, cyan.

While the paper is fed through the printer, a text image was repeatedly recorded at an image-printing ratio of 1% on an A4-size plain paper. The dark-portion potential and light-portion potential were measured at an initial stage of image recording and after recording of 20,000 images. Thus, a change in dark-portion potential (ΔVd) and a change in light-portion potential (ΔV1) that occurred during recording of 20,000 images were determined. Table 15 shows the evaluation results.

TABLE 15

| Example | Black dots | Potential Change ΔVd | Potential Change ΔVI | Example/ Comparative Example | Black dots | Potential Change ΔVd | Potential Change ΔVI |
|---|---|---|---|---|---|---|---|
| 1 | A | 5 | 15 | 46 | A | 15 | 20 |
| 2 | A | 5 | 10 | 47 | A | 25 | 25 |
| 3 | A | 10 | 15 | 48 | A | 15 | 20 |
| 4 | A | 5 | 10 | 49 | B | 15 | 20 |
| 5 | A | 10 | 15 | 50 | A | 20 | 25 |
| 6 | A | 0 | 10 | 51 | C | 25 | 20 |
| 7 | A | 5 | 10 | 52 | C | 20 | 25 |
| 8 | A | 5 | 5 | 53 | C | 20 | 20 |
| 9 | A | 5 | 10 | 54 | C | 25 | 25 |
| 10 | A | 10 | 15 | 55 | C | 20 | 25 |
| 11 | A | 5 | 15 | 56 | A | 5 | 10 |
| 12 | A | 10 | 10 | 57 | A | 5 | 15 |
| 13 | A | 5 | 15 | 58 | A | 10 | 10 |
| 14 | A | 0 | 15 | 59 | A | 5 | 15 |
| 15 | A | 5 | 10 | 60 | A | 0 | 15 |
| 16 | A | 5 | 15 | 61 | A | 5 | 10 |
| 17 | A | 5 | 10 | 62 | A | 5 | 15 |
| 18 | A | 10 | 15 | 63 | A | 5 | 10 |
| 19 | A | 10 | 10 | 64 | A | 10 | 15 |
| 20 | A | 5 | 15 | 65 | A | 10 | 10 |
| 21 | A | 0 | 15 | 66 | A | 5 | 15 |
| 22 | A | 5 | 10 | 67 | B | 0 | 15 |
| 23 | A | 5 | 15 | 68 | B | 5 | 10 |
| 24 | A | 5 | 10 | 69 | B | 5 | 15 |
| 25 | A | 10 | 15 | 70 | A | 5 | 10 |
| 26 | A | 5 | 15 | 71 | A | 5 | 10 |
| 27 | A | 5 | 10 | 72 | A | 10 | 15 |
| 28 | A | 10 | 15 | 73 | B | 10 | 10 |
| 29 | A | 5 | 10 | 74 | B | 5 | 15 |
| 30 | A | 5 | 5 | 75 | B | 0 | 15 |
| 31 | A | 30 | 30 | 76 | B | 5 | 10 |
| 32 | A | 30 | 35 | 77 | A | 5 | 15 |
| 33 | A | 5 | 15 | 78 | A | 5 | 10 |
| 34 | A | 10 | 10 | 79 | A | 10 | 15 |
| 35 | A | 5 | 15 | 80 | B | 5 | 15 |
| 36 | A | 0 | 15 | 81 | B | 5 | 10 |
| 37 | B | 5 | 10 | 82 | B | 10 | 15 |
| 38 | B | 10 | 10 | 83 | B | 10 | 15 |
| 39 | A | 20 | 25 | 84 | A | 15 | 20 |
| 40 | A | 20 | 25 | 85 | A | 20 | 15 |
| 41 | A | 15 | 20 | 86 | A | 15 | 25 |

TABLE 15-continued

| Example | Black dots | Potential Change ΔVd | Potential Change ΔVI | Example/ Comparative Example | Black dots | Potential Change ΔVd | Potential Change ΔVI |
|---|---|---|---|---|---|---|---|
| 42 | A | 25 | 25 | Comparative Example 1 | D | 30 | 40 |
| 43 | A | 30 | 30 | Comparative Example 2 | D | 20 | 35 |
| 44 | A | 30 | 35 | Comparative Example 3 | D | 45 | 40 |
| 45 | A | 20 | 25 | | | | |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-211991, filed Oct. 9, 2013 and No. 2014-176312, filed Aug. 29, 2014, which are hereby incorporated by reference herein in their entirety.

What is claimed is:

1. An electrophotographic photosensitive member comprising:
- a conductive support;
- an undercoat layer on the support; and
- a photosensitive layer on the undercoat layer,
- wherein the undercoat layer comprises:
  - three dimensional crosslinked product including a portion having electron transportability as a partial structure; and
  - a particle including titanium oxide, and
- wherein a surface layer of the electrophotographic photosensitive member comprises a product of a composition comprising:
  - a hole transporting substance having a polymerizable functional group; and
  - a photopolymerization initiator.

2. The electrophotographic photosensitive member according to claim 1,
- wherein the undercoat layer is a laminated undercoat layer comprising a first undercoat layer and a second undercoat layer formed on the first undercoat layer;
- wherein the first undercoat layer comprises the particle including titanium oxide; and
- wherein the second undercoat layer comprises the product having electron transportability.

3. The electrophotographic photosensitive member according to claim 1,
- wherein the three dimensional crosslinked product is a cured product of a composition comprising:
  - an electron transporting substance having a polymerizable functional group; and
  - a crosslinking agent.

4. The electrophotographic photosensitive member according to claim 3,
- wherein a band gap between a ground state and a triplet excited level of the electron transporting substance is 0.5 eV or more and 3.0 eV or less.

5. The electrophotographic photosensitive member according to claim 3,
- wherein the crosslinking agent is,
  - an isocyanate compound having three to six isocyanate groups or three to six blocked isocyanate groups; or
  - an amine compound having three to six monovalent groups represented by $—CH_2—OR^1$, where $R^1$ represents a hydrogen atom or an alkyl group having 1 to 10 carbon atoms.

6. The electrophotographic photosensitive member according to claim 1,
- wherein the content of the three dimensional crosslinked product is 10% by mass or more and 70% by mass or less relative to the total mass of the particle including titanium oxide and the three dimensional crosslinked product.

7. The electrophotographic photosensitive member according to claim 1,
- wherein the total content of the particle including titanium oxide and the three dimensional crosslinked product is 40% by mass or more and 80% by mass or less relative to the whole mass of the undercoat layer.

8. The electrophotographic photosensitive member according to claim 1,
- wherein the surface layer comprises a product of a composition comprising:
  - the hole transporting substance having a polymerizable functional group;
  - a radical-polymerizable monomer which does not have hole transportability; and
  - a photopolymerization initiator.

9. The electrophotographic photosensitive member according to claim 1,
- wherein the three dimensional crosslinked product is a product of a composition comprising:
  - an electron transporting substance having a polymerizable functional group;
  - a resin having a polymerizable functional group; and
  - a crosslinking agent.

10. A process cartridge detachably attachable to a main body of an electrophotographic apparatus, the process cartridge integrally supporting:
- electrophotographic photosensitive member according to claim 1; and
- at least one unit selected from the group consisting of a charging unit, a developing unit, and a cleaning unit.

11. An electrophotographic apparatus comprising:
- the electrophotographic photosensitive member according to claim 1;
- a charging unit;
- a developing unit; and
- a transfer unit.

12. A method for producing an electrophotographic photosensitive member comprising a conductive support, an undercoat layer on the support, and a photosensitive layer on the undercoat layer, the method comprising the steps of:
- (i) forming the undercoat layer comprising a three dimensional crosslinked product including a portion having electron transportability as a particle structure and a particle including titanium oxide;
- (ii) forming a coating film of a coating liquid, the coating liquid comprising a composition comprising a hole transporting substance having a polymerizable functional group and a photopolymerization initiator; and
- (iii) irradiating the coating film with ultraviolet radiation to cause the composition to be in order to form a surface layer of the electrophotographic photosensitive member.

13. The method for producing an electrophotographic photosensitive member according to claim 12,
- wherein the three dimensional crosslinked product is a product of a composition comprising:

an electron transporting substance having a polymerizable functional group; and a crosslinking agent.

14. The method for producing an electrophotographic photosensitive member according to claim 13, wherein a band gap between a ground state and a triplet excited level of the electron transporting substance is 0.5 eV or more and 3.0 eV or less.

15. The method for producing an electrophotographic photosensitive member according to claim 12, wherein the composition comprising the hole transporting substance having a polymerizable functional group and the photopolymerization initiator further comprises a radical-polymerizable monomer which does not have hole transportability.

16. A method for producing an electrophotographic photosensitive member comprising a conductive support, an undercoat layer on the support, and a photosensitive layer on the undercoat layer, the undercoat layer being a laminated undercoat layer comprising a first undercoat layer and a second undercoat layer formed on the first undercoat layer, the method comprising the steps of:

(i) forming the first undercoat layer comprising a particle including titanium oxide;

(ii) forming the second undercoat layer on the first undercoat layer, the second undercoat layer comprising a three dimensional crosslinked product including a portion having electron transportability as a partial structure;

(iii) forming a coating film of a coating liquid, the coating liquid comprising a composition comprising a hole transporting substance having a polymerizable functional group and a photopolymerization initiator; and (iv) irradiating the coating film with ultraviolet radiation to cause the composition to be in order to form a surface layer of the electrophotographic photosensitive member.

17. The method for producing an electrophotographic photosensitive member according to claim 16, wherein the three dimensional crosslinked product having electron transportability is a product of a composition comprising:

an electron transporting substance having a polymerizable functional group; and a crosslinking agent.

18. The method for producing an electrophotographic photosensitive member according to claim 17, wherein a band gap between a ground state and a triplet excited level of the electron transporting substance is 0.5 eV or more and 3.0 eV or less.

19. The method for producing an electrophotographic photosensitive member according to claim 16, wherein the composition comprising the hole transporting substance having a polymerizable functional group and the photopolymerization initiator further comprises a radical-polymerizable monomer which does not have hole transportability.

* * * * *